US012179072B2

(12) United States Patent
Nicolette et al.

(10) Patent No.: US 12,179,072 B2
(45) Date of Patent: Dec. 31, 2024

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Michael R. Nicolette, Scottsdale, AZ (US); Bradley D. Schweigert, Cave Creek, AZ (US); Caleb S. Kroloff, Phoenix, AZ (US)

(73) Assignee: PARSONS EXTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 18/526,060

(22) Filed: Dec. 1, 2023

(65) Prior Publication Data

US 2024/0108950 A1 Apr. 4, 2024

Related U.S. Application Data

(63) Continuation-in-part of application No. 18/201,320, filed on May 24, 2023, which is a continuation of (Continued)

(51) Int. Cl.

| | |
|---|---|
| ***A63B 53/04*** | (2015.01) |
| ***A63B 60/02*** | (2015.01) |
| *A63B 53/06* | (2015.01) |

(52) U.S. Cl.

CPC ..... *A63B 53/0466* (2013.01); *A63B 53/04* (2013.01); *A63B 60/02* (2015.10); (Continued)

(58) Field of Classification Search

CPC ... A63B 53/005; A63B 53/04; A63B 53/0416; A63B 53/0454; A63B 53/0458; A63B 53/0462

See application file for complete search history.

(56) References Cited

U.S. PATENT DOCUMENTS 2,087,685 A * 7/1937 Hackney ..... A63B 53/0466 D21/747
3,814,437 A * 6/1974 Winquist ..... A63B 60/00 473/324

(Continued)

FOREIGN PATENT DOCUMENTS

CA 2218837 A1 * 4/1998
CN 101116774 A * 2/2008 ..... A63B 53/04

(Continued)

*Primary Examiner* — Alvin A Hunter

(57) ABSTRACT

Embodiments of golf club heads and methods to manufacture golf club heads are generally described herein. In one example, a golf club head includes a body portion and a face portion attached to the body portion that comprises a center portion having a first thickness, a perimeter portion having a second thickness greater than the first thickness, spoke portions extending radially from the center portion to the perimeter portion, and recessed portions. Each recessed portion is located between two spoke portions, and each recessed portion extends from the center portion to the perimeter portion. The thickness of each spoke portion increases from the first thickness to the second thickness in a direction from the center portion to the perimeter portion, and each recessed portion has the first thickness from the center portion to the perimeter portion. Other examples and embodiments may be described and claimed.

20 Claims, 20 Drawing Sheets

Related U.S. Application Data application No. 17/231,832, filed on Apr. 15, 2021, now Pat. No. 11,697,050, and a continuation-in-part of application No. 17/205,887, filed on Mar. 18, 2021, now Pat. No. 11,752,402, which is a continuation of application No. 16/820,366, filed on Mar. 16, 2020, now Pat. No. 10,981,037, said application No. 17/231,832 is a continuation of application No. 16/713,942, filed on Dec. 13, 2019, now Pat. No. 11,000,742, said application No. 16/820,366 is a continuation of application No. 16/418,691, filed on May 21, 2019, now Pat. No. 10,653,928, and a continuation-in-part of application No. 16/375,553, filed on Apr. 4, 2019, now Pat. No. 10,695,623, and a continuation-in-part of application No. 16/372,009, filed on Apr. 1, 2019, now Pat. No. 10,821,334, and a continuation-in-part of application No. 16/290,610, filed on Mar. 1, 2019, now Pat. No. 10,617,918, said application No. 16/713,942 is a continuation of application No. 16/198,128, filed on Nov. 21, 2018, now Pat. No. 10,532,257, said application No. 16/375,553 is a continuation of application No. 15/967,117, filed on Apr. 30, 2018, now Pat. No. 10,293,221, said application No. 16/290,610 is a continuation of application No. 15/875,496, filed on Jan. 19, 2018, now Pat. No. 10,252,123, said application No. 16/372,009 is a continuation of application No. 15/875,416, filed on Jan. 19, 2018, now Pat. No. 10,293,220, said application No. 16/418,691 is a continuation of application No. 15/803,157, filed on Nov. 3, 2017, now Pat. No. 10,335,645, said application No. 16/198,128 is a continuation of application No. 15/583,756, filed on May 1, 2017, now Pat. No. 10,143,899, said application No. 15/875,496 is a continuation of application No. 15/457,627, filed on Mar. 13, 2017, now Pat. No. 9,895,583, said application No. 15/967,117 is a continuation of application No. 15/457,618, filed on Mar. 13, 2017, now Pat. No. 9,987,526, said application No. 15/875,416 is a continuation of application No. 15/446,842, filed on Mar. 1, 2017, now Pat. No. 9,895,582, which is a continuation of application No. 15/377,120, filed on Dec. 13, 2016, now Pat. No. 9,802,087, said application No. 15/803,157 is a continuation of application No. 15/290,859, filed on Oct. 11, 2016, now Pat. No. 9,814,945, said application No. 15/583,756 is a continuation of application No. 15/271,574, filed on Sep. 21, 2016, now Pat. No. 9,669,270, said application No. 15/457,627 is a continuation of application No. 15/189,806, filed on Jun. 22, 2016, now Pat. No. 9,636,554, said application No. 15/457,618 is a continuation of application No. 15/163,393, filed on May 24, 2016, now Pat. No. 9,662,547, said application No. 15/290,859 is a continuation of application No. 15/040,892, filed on Feb. 10, 2016, now Pat. No. 9,550,096, said application No. 15/377,120 is a continuation of application No. 14/939,849, filed on Nov. 12, 2015, now Pat. No. 9,555,295, said application No. 15/189,806 is a continuation of application No. 14/667,546, filed on Mar. 24, 2015, now Pat. No. 9,399,158, said application No. 15/163,393 is a continuation of application No. 14/667,541, filed on Mar. 24, 2015, now Pat. No. 9,352,197, said application No. 14/939,849 is a continuation of application No. 14/615,606, filed on Feb. 6, 2015, now Pat. No. 9,199,140, said application No. 14/667,541 is a continuation-in-part of application No. 14/615,606, filed on Feb. 6, 2015, now Pat. No. 9,199,140, said application No. 14/667,546 is a continuation-in-part of application No. 14/615,606, filed on Feb. 6, 2015, now Pat. No. 9,199,140.

(60) Provisional application No. 63/445,747, filed on Feb. 15, 2023, provisional application No. 63/441,987, filed on Jan. 30, 2023, provisional application No. 62/291,793, filed on Feb. 5, 2016, provisional application No. 62/195,211, filed on Jul. 21, 2015, provisional application No. 62/194,135, filed on Jul. 17, 2015, provisional application No. 62/184,757, filed on Jun. 25, 2015, provisional application No. 62/138,918, filed on Mar. 26, 2015, provisional application No. 62/120,760, filed on Feb. 25, 2015, provisional application No. 62/115,024, filed on Feb. 11, 2015, provisional application No. 62/109,510, filed on Jan. 29, 2015, provisional application No. 62/105,123, filed on Jan. 19, 2015, provisional application No. 62/101,543, filed on Jan. 9, 2015, provisional application No. 62/048,693, filed on Sep. 10, 2014, provisional application No. 62/042,155, filed on Aug. 26, 2014.

(52) U.S. Cl.
CPC ..... *A63B 53/0408* (2020.08); *A63B 53/0412* (2020.08); *A63B 53/0433* (2020.08); *A63B 2053/0491* (2013.01); *A63B 53/06* (2013.01); *A63B 2209/00* (2013.01)

(56) References Cited

U.S. PATENT DOCUMENTS 4,553,755 A * 11/1985 Yamada ..... A63B 53/04 473/346
4,883,274 A * 11/1989 Hsien ..... A63B 60/00 473/335
5,014,993 A * 5/1991 Antonious ..... A63B 53/047 473/350
5,082,278 A * 1/1992 Hsien ..... A63B 60/00 473/335
5,219,408 A 6/1993 Sun
5,328,184 A * 7/1994 Antonious ..... A63B 60/00 473/346
5,433,439 A * 7/1995 Hsien ..... A63B 53/04 473/289
5,447,307 A * 9/1995 Antonious ..... A63B 53/047 473/350
5,482,280 A * 1/1996 Yamawaki ..... A63B 53/00 473/290
5,497,993 A * 3/1996 Shan ..... A63B 53/0466 473/347
5,669,824 A 9/1997 Aizawa et al.
D386,550 S 11/1997 Wright et al.
D386,551 S 11/1997 Solheim et al.
D387,405 S 12/1997 Solheim et al.
5,830,084 A * 11/1998 Kosmatka ..... A63B 60/00 473/324
5,971,868 A * 10/1999 Kosmatka ..... A63B 69/3635 473/324
D428,634 S 7/2000 Nagai et al.
6,354,962 B1 3/2002 Galloway et al.
6,368,234 B1 * 4/2002 Galloway ..... A63B 60/00 473/324
6,379,262 B1 * 4/2002 Boone ..... A63B 53/04 473/324
6,390,933 B1 * 5/2002 Galloway ..... A63B 53/0466 473/305
6,398,666 B1 * 6/2002 Evans ..... A63B 53/04 473/345

(56) References Cited

U.S. PATENT DOCUMENTS 6,413,169 B1 * 7/2002 Kosmatka ..... A63B 53/04 473/224
6,428,426 B1 * 8/2002 Helmstetter ..... A63B 60/00 473/331
6,435,977 B1 8/2002 Helmstetter et al.
6,454,665 B2 9/2002 Antonious
6,506,127 B2 1/2003 Helmstetter et al.
6,602,150 B1 * 8/2003 Kosmatka ..... A63B 53/0466 473/332
6,620,056 B2 9/2003 Galloway et al.
6,623,377 B2 9/2003 Evans et al.
6,641,491 B1 11/2003 Schillaci
6,652,391 B1 * 11/2003 Kubica ..... A63B 53/02 473/345
6,746,343 B2 6/2004 Yoneyama
6,800,040 B2 10/2004 Galloway et al.
6,840,872 B2 1/2005 Yoneyama
6,863,626 B2 3/2005 Evans et al.
6,926,618 B2 * 8/2005 Sanchez ..... A63B 53/04 473/345
6,997,821 B2 2/2006 Galloway et al.
7,014,570 B2 3/2006 Evans et al.
7,041,003 B2 5/2006 Bissonnette et al.
7,101,289 B2 9/2006 Gibbs et al.
7,125,344 B2 10/2006 Hocknell et al.
7,137,907 B2 * 11/2006 Gibbs ..... A63B 53/0466 473/345
7,144,336 B2 12/2006 Reyes et al.
7,147,757 B2 12/2006 Luyken et al.
7,169,062 B2 * 1/2007 Chen ..... A63B 53/0466 473/329
7,258,626 B2 8/2007 Gibbs et al.
7,261,646 B2 8/2007 Shiell et al.
7,387,579 B2 6/2008 Lin et al.
7,399,238 B2 7/2008 Hocknell et al.
7,422,528 B2 9/2008 Gibbs et al.
7,442,132 B2 10/2008 Nishio
7,448,960 B2 11/2008 Gibbs et al.
7,494,425 B2 2/2009 Shiell et al.
7,494,426 B2 * 2/2009 Nishio ..... A63B 53/0466 473/350
7,549,935 B2 * 6/2009 Foster ..... A63B 53/0466 473/335
7,575,524 B2 * 8/2009 Willett ..... A63B 53/047 473/345
7,607,992 B2 * 10/2009 Nishio ..... A63B 53/0466 473/347
7,614,964 B2 * 11/2009 Matsunaga ..... A63B 60/00 473/346
7,618,331 B2 * 11/2009 Hirano ..... A63B 60/00 473/346
7,713,140 B2 5/2010 Gibbs et al.
7,749,102 B2 * 7/2010 Nakamura ..... A63B 53/047 473/349
7,967,700 B2 6/2011 Stites
8,012,041 B2 * 9/2011 Gibbs ..... A63B 53/02 473/345
8,016,691 B2 9/2011 Stites
8,070,623 B2 * 12/2011 Stites ..... A63B 53/0466 473/346
8,096,896 B2 1/2012 Schiell et al.
8,226,498 B2 7/2012 Stites et al.
8,287,402 B2 10/2012 Shiell et al.
8,376,876 B2 * 2/2013 Gibbs ..... A63B 60/00 473/345
8,382,609 B2 * 2/2013 Yokota ..... A63B 60/00 473/346
8,403,769 B2 3/2013 Stites
8,425,341 B2 * 4/2013 Takechi ..... A63B 53/0466 473/331
8,439,769 B2 * 5/2013 Rice ..... A63B 60/00 473/345
8,465,379 B2 * 6/2013 Wada ..... A63B 60/00 473/346
8,469,834 B2 * 6/2013 Wada ..... A63B 53/0466 473/346
8,602,912 B2 12/2013 Stites
8,657,701 B2 2/2014 Boyd et al.
8,690,702 B2 * 4/2014 Abe ..... A63B 53/0466 473/316
8,696,489 B2 * 4/2014 Gibbs ..... A63B 53/02 473/345
8,801,543 B2 8/2014 Stites
8,814,724 B2 * 8/2014 Kato ..... A63B 53/0466 473/349
8,845,454 B2 9/2014 Boyd et al.
8,915,794 B2 12/2014 Stites
8,956,248 B2 * 2/2015 DeMille ..... A63B 53/04 473/344
9,101,809 B2 * 8/2015 Gibbs ..... A63B 60/00
9,168,436 B2 * 10/2015 Slaughter ..... A63B 53/047
9,452,325 B2 9/2016 DeShiell et al.
9,669,270 B2 * 6/2017 Schweigert ..... A63B 60/00
9,717,959 B2 8/2017 Stites
9,839,821 B2 12/2017 DeShiell et al.
10,143,899 B2 * 12/2018 Schweigert ..... A63B 60/00
10,434,379 B2 * 10/2019 Brunski ..... A63B 53/0466
10,532,257 B2 * 1/2020 Schweigert ..... A63B 1/00
11,000,742 B2 * 5/2021 Schweigert ..... A63B 53/0466
11,117,029 B2 9/2021 Slaughter et al.
11,697,050 B2 * 7/2023 Schweigert ..... A63B 53/0466 29/592
2001/0051548 A1 * 12/2001 Iwata ..... A63B 53/04 473/329
2002/0028714 A1 3/2002 Kosmatka
2002/0049094 A1 * 4/2002 Kosmatka ..... A63B 60/00 473/329
2002/0065146 A1 * 5/2002 Kusumoto ..... A63B 60/00 473/345
2002/0169034 A1 * 11/2002 Hocknell ..... C22F 1/183 473/345
2002/0193175 A1 * 12/2002 Soracco ..... C22F 1/183 473/345
2003/0036442 A1 * 2/2003 Chao ..... A63B 53/0466 473/345
2003/0092505 A1 * 5/2003 Liou ..... A63B 60/00 473/345
2003/0199335 A1 10/2003 Bissonnette et al.
2003/0220157 A1 * 11/2003 Dennis ..... A63B 60/00 473/342
2004/0023730 A1 * 2/2004 Nagai ..... A63B 53/04 473/345
2004/0132544 A1 * 7/2004 Doi ..... A63B 53/0466 473/305
2004/0219991 A1 * 11/2004 Suprock ..... A63B 53/0466 473/345
2004/0235585 A1 * 11/2004 Sanchez ..... A63B 53/04 473/346
2005/0003901 A1 * 1/2005 Kuroda ..... C22C 14/00 473/324
2005/0023329 A1 * 2/2005 Song ..... A63B 53/0466 228/234.1
2005/0090331 A1 * 4/2005 Oyama ..... A63B 53/0466 473/345
2005/0101407 A1 * 5/2005 Hirano ..... A63B 60/00 473/342
2005/0209019 A1 * 9/2005 Schweigert ..... A63B 60/00 473/345
2005/0209021 A1 9/2005 Hoffman et al.
2006/0063606 A1 * 3/2006 Schweigert ..... B23C 3/16 473/345
2006/0073907 A1 * 4/2006 Murphy ..... A63B 53/0466 473/349
2006/0079347 A1 * 4/2006 Gibbs ..... A63B 53/04 473/345
2006/0111201 A1 * 5/2006 Nishio ..... A63B 53/0466 473/346
2006/0172819 A1 * 8/2006 Sano ..... A63B 53/0466 473/345

(56) References Cited

U.S. PATENT DOCUMENTS

2006/0194644 A1* 8/2006 Nishio ..... A63B 53/0466 473/345
2007/0207877 A1* 9/2007 Nishio ..... A63B 53/0466 473/345
2008/0004129 A1 1/2008 Lin et al.
2008/0096689 A1* 4/2008 Oyama ..... A63B 53/0466 473/349
2008/0125246 A1* 5/2008 Matsunaga ..... A63B 60/00 473/346
2008/0248896 A1* 10/2008 Hirano ..... A63B 60/02 473/346
2009/0082134 A1* 3/2009 Matsunaga ..... A63B 53/0466 473/349
2009/0143167 A1* 6/2009 Evans ..... A63B 53/0466 473/335
2009/0163296 A1* 6/2009 Chao ..... A63B 53/0466 264/258
2009/0264218 A1 10/2009 Willett et al.
2009/0286622 A1* 11/2009 Yokota ..... A63B 60/00 473/345
2010/0178997 A1* 7/2010 Gibbs ..... A63B 53/0466 473/345
2010/0267461 A1* 10/2010 Stites ..... A63B 53/0466 473/242
2010/0267463 A1* 10/2010 Stites ..... A63B 53/047 473/409
2010/0273570 A1* 10/2010 Ines ..... A63B 53/047 473/349
2010/0304889 A1* 12/2010 Wada ..... A63B 53/0466 473/349
2011/0201451 A1* 8/2011 Wada ..... A63B 60/00 473/346
2012/0021849 A1 1/2012 Gibbs et al.
2012/0064994 A1 3/2012 Wada et al.
2012/0108359 A1* 5/2012 Abe ..... A63B 53/10 473/345
2012/0129627 A1* 5/2012 Hirano ..... A63B 53/0466 473/346
2012/0322577 A1* 12/2012 Wada ..... A63B 53/0466 473/345
2013/0040752 A1* 2/2013 Ashino ..... A63B 53/0466 473/287
2013/0165257 A1* 6/2013 Dipert ..... A63B 60/00 473/349
2013/0344990 A1* 12/2013 Slaughter ..... A63B 53/04 473/349
2014/0038745 A1* 2/2014 Abe ..... A63B 53/0466 473/330
2014/0213387 A1* 7/2014 Samson ..... A63B 60/00 473/345
2015/0038256 A1* 2/2015 Ashino ..... A63B 53/0466 473/324
2015/0038260 A1* 2/2015 Hayashi ..... A63B 53/04 473/342
2015/0045143 A1* 2/2015 Abe ..... A63B 60/52 473/330
2015/0045144 A1* 2/2015 Abe ..... A63B 60/52 473/330
2015/0375068 A1* 12/2015 Mizutani ..... A63B 53/0466 473/324
2017/0007892 A1* 1/2017 Schweigert ..... A63B 53/04
2019/0282864 A1* 9/2019 Aramaki ..... A63B 53/0462
2020/0114227 A1* 4/2020 Schweigert ..... A63B 53/04

FOREIGN PATENT DOCUMENTS

GB 2331249 A * 5/1999 ..... A63B 53/04
GB 2401797 A * 11/2004 ..... A63B 53/04
JP 09239074 A * 9/1997 ..... A63B 53/0466
JP 11019255 A * 1/1999 ..... A63B 53/04
JP 11235406 A * 8/1999 ..... A63B 53/0466
JP 2000093561 A * 4/2000 ..... A63B 53/005
JP 2001286586 A * 10/2001 ..... A63B 53/04
JP 2002143351 A * 5/2002 ..... A63B 53/04
JP 2003033451 A * 2/2003 ..... A63B 53/0466
JP 2003245384 A * 9/2003 ..... A63B 53/0466
JP 2003339921 A * 12/2003 ..... A63B 53/04
JP 2004174100 A * 6/2004 ..... A63B 53/0466
JP 2006087783 A 4/2006
JP 2006141806 A * 6/2006 ..... A63B 53/04
JP 2010253247 A * 11/2010 ..... A63B 53/0466
JP 2012139410 A * 7/2012 ..... A63B 53/00
JP 2014210205 A * 11/2014 ..... A63B 53/04
JP 5690766 B2 3/2015

* cited by examiner

GOLF CLUB HEADS AND METHODS TO MANUFACTURE GOLF CLUB HEADS

CROSS REFERENCE

This application claims the benefit of U.S. Provisional Application Nos. 63/445,747, filed Feb. 15, 2023, and 63/441,987, filed Jan. 30, 2023.

This application is a continuation-in-part of application Ser. No. 18/201,320, filed May 24, 2023, which is a continuation of application Ser. No. 17/231,832, filed Apr. 15, 2021, now U.S. Pat. No. 11,697,050, which is a continuation of application Ser. No. 16/713,942, filed Dec. 13, 2019, now U.S. Pat. No. 11,000,742, which is a continuation of application Ser. No. 16/198,128, filed Nov. 21, 2018, now U.S. Pat. No. 10,532,257, which is a continuation of application Ser. No. 15/583,756, filed May 1, 2017, now U.S. Pat. No. 10,143,899, which is a continuation of application Ser. No. 15/271,574, filed Sep. 21, 2016, now U.S. Pat. No. 9,669,270, which claims the benefit of U.S. Provisional Application No. 62/291,793, filed Feb. 5, 2016.

U.S. application Ser. No. 18/201,320, filed May 24, 2023, is a continuation-in-part of application Ser. No. 17/205,887, filed Mar. 18, 2021, now U.S. Pat. No. 11,752,402, which is a continuation of application Ser. No. 16/820,366, filed Mar. 16, 2020, now U.S. Pat. No. 10,981,037, which is a continuation of application Ser. No. 16/418,691, filed May 21, 2019, now U.S. Pat. No. 10,653,928, which is a continuation of application Ser. No. 15/803,157, filed Nov. 3, 2017, now U.S. Pat. No. 10,335,645, which is a continuation of application Ser. No. 15/290,859, filed Oct. 11, 2016, now U.S. Pat. No. 9,814,945, which is a continuation of application Ser. No. 15/040,892, filed Feb. 10, 2016, now U.S. Pat. No. 9,550,096, which claims the benefit of U.S. Provisional Application No. 62/115,024, filed Feb. 11, 2015, U.S. Provisional Application No. 62/120,760, filed Feb. 25, 2015, U.S. Provisional Application No. 62/138,918, filed Mar. 26, 2015, U.S. Provisional Application No. 62/184,757, filed Jun. 25, 2015, U.S. Provisional No. 62/194,135, filed Jul. 17, 2015, and U.S. Provisional Application No. 62/195,211, filed Jul. 21, 2015.

U.S. application Ser. No. 16/820,366, filed Mar. 16, 2020, is a continuation-in-part of application Ser. No. 16/372,009, filed Apr. 1, 2019, now U.S. Pat. No. 10,821,334, which is a continuation of application Ser. No. 15/875,416, filed Jan. 19, 2018, now U.S. Pat. No. 10,293,220, which is a continuation of application Ser. No. 15/446,842, filed Mar. 1, 2017, now U.S. Pat. No. 9,895,582, which is a continuation of application Ser. No. 15/377,120, filed Dec. 13, 2016, now U.S. Pat. No. 9,802,087, which is a continuation of application Ser. No. 14/939,849, filed Nov. 12, 2015, now U.S. Pat. No. 9,555,295, which is a continuation of application Ser. No. 14/615,606, filed Feb. 6, 2015, now U.S. Pat. No. 9,199,140.

U.S. application Ser. No. 16/820,366, filed Mar. 16, 2020, is a continuation-in-part of application Ser. No. 16/290,610, filed Mar. 1, 2019, now U.S. Pat. No. 10,617,918, which is a continuation of application Ser. No. 15/875,496, filed Jan. 19, 2018, now U.S. Pat. No. 10,252,123, which is a continuation of application Ser. No. 15/457,627, filed Mar. 13, 2017, now U.S. Pat. No. 9,895,583, which is a continuation of application Ser. No. 15/189,806, filed Jun. 22, 2016, now U.S. Pat. No. 9,636,554, which is a continuation of application Ser. No. 14/667,546, filed Mar. 24, 2015, now U.S. Pat. No. 9,399,158, which is a continuation-in-part of application Ser. No. 14/615,606, filed Feb. 6, 2015, now U.S. Pat. No. 9,199,140, which claims the benefit of U.S. Provisional Application No. 62/042,155, filed Aug. 26, 2014, U.S. Provisional Application No. 62/048,693, filed Sep. 10, 2014, U.S. Provisional Application No. 62/101,543, filed Jan. 9, 2015, U.S. Provisional Application No. 62/105,123, filed Jan. 19, 2015, and U.S. Provisional Application No. 62/109,510, filed Jan. 29, 2015.

U.S. application Ser. No. 16/820,366, filed Mar. 16, 2020, is a continuation-in-part of application Ser. No. 16/375,553, filed Apr. 4, 2019, now U.S. Pat. No. 10,695,623, which is a continuation of application Ser. No. 15/967,117, filed Apr. 30, 2018, now U.S. Pat. No. 10,293,221, which is a continuation application Ser. No. 15/457,618, filed Mar. 13, 2017, now U.S. Pat. No. 9,987,526, which is a continuation of application Ser. No. 15/163,393, filed May 24, 2016, now U.S. Pat. No. 9,662,547, which is a continuation of application Ser. No. 14/667,541, filed Mar. 24, 2015, now U.S. Pat. No. 9,352,197, which is a continuation-in-part of application Ser. No. 14/615,606, filed Feb. 6, 2015, now U.S. Pat. No. 9,199,140, which claims the benefit of U.S. Provisional Application No. 62/042,155, filed Aug. 26, 2014, U.S. Provisional Application No. 62/048,693, filed Sep. 10, 2014, U.S. Provisional Application No. 62/101,543, filed Jan. 9, 2015, U.S. Provisional Application No. 62/105,123, filed Jan. 19, 2015, and U.S. Provisional Application No. 62/109,510, filed Jan. 29, 2015.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to sports equipment, and more particularly, to golf club heads and methods to manufacture golf club heads.

BACKGROUND

In golf, various factors may affect a distance and direction that a golf ball may travel. In particular, a center of gravity (CG) and/or a moment of inertia (MOI) of a golf club head may affect a launch angle, spin rate, and direction of the golf ball at impact. Such factors may vary significantly based on a type of golf swing.

Figure 1:
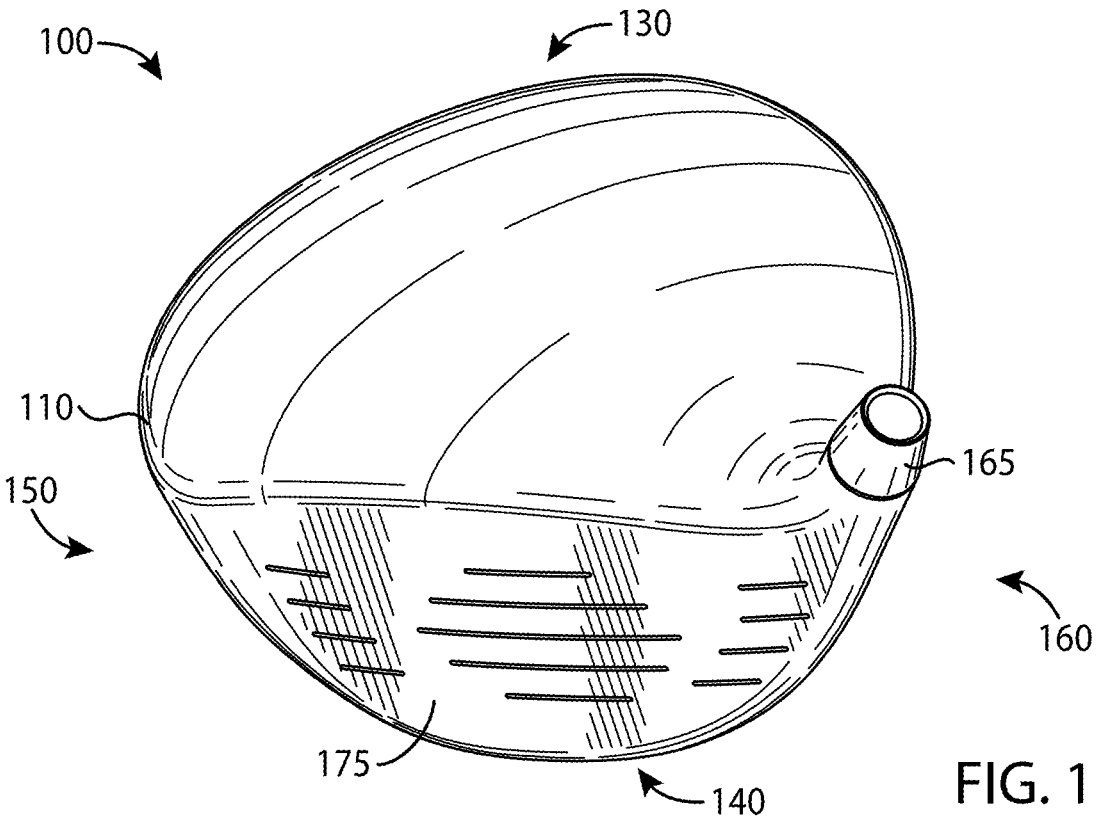
FIG. 1 is top perspective view of an example golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard.

Figure 2:
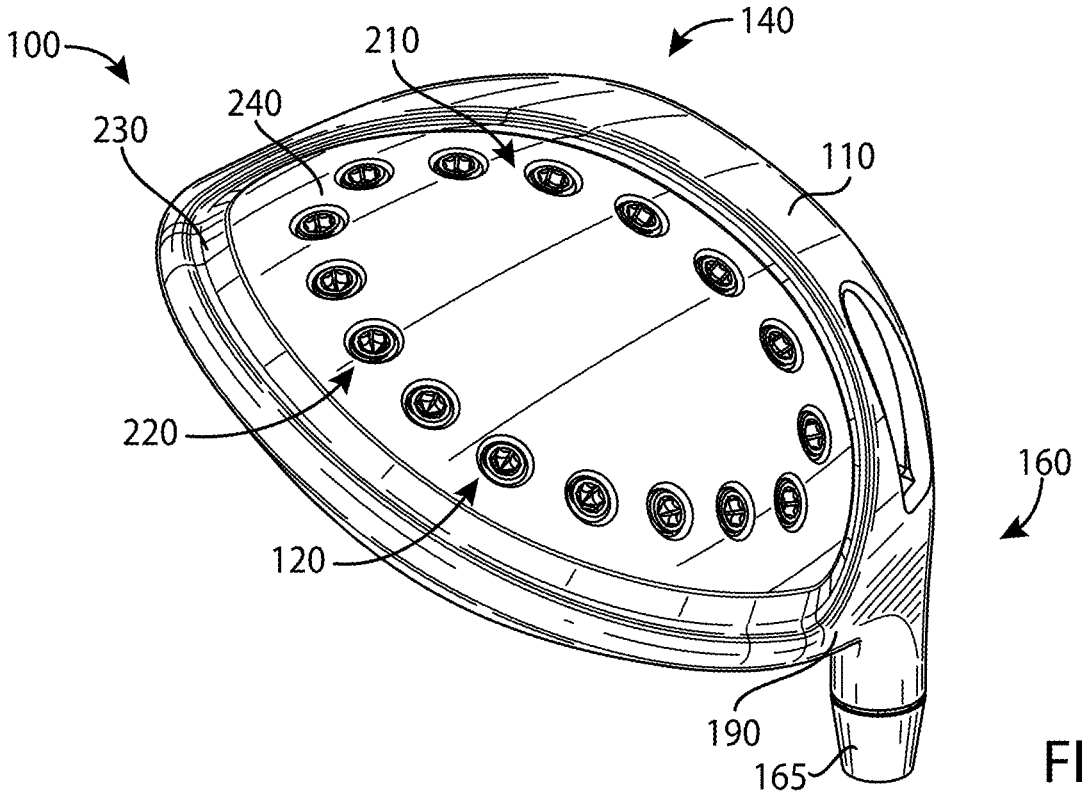
FIG. 2 depicts a bottom perspective view of the example golf club head of FIG. 1.
Figure 3:
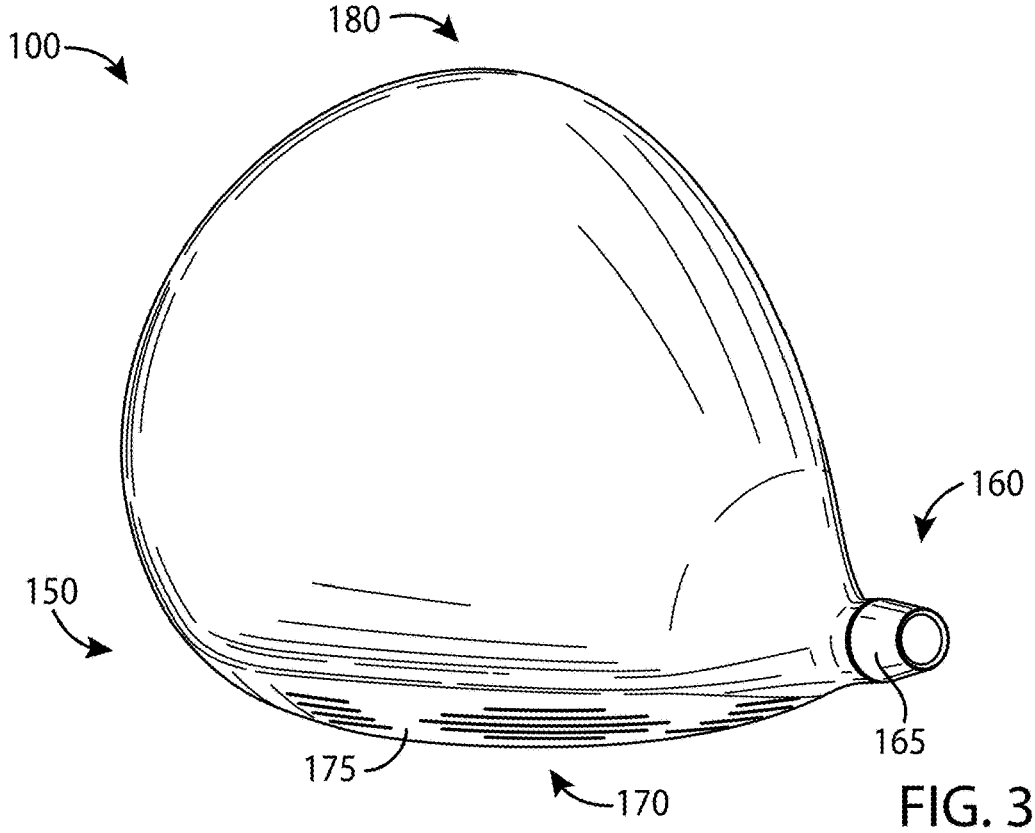
FIG. 3 depicts a top view of the example golf club head of FIG. 1.

In the example of FIGS. 1-13, a golf club head 100 may include a body portion 110, and a plurality of weight portions 120, generally, shown as a first set of weight portions 210 (FIG. 2) and a second set of weight portions 220 (FIG. 2). The body portion 110 may include a top portion 130, a bottom portion 140, a toe portion 150, a heel portion 160, a front portion 170, and a rear portion 180. The bottom portion 140 may include a skirt portion 190 defined as a side portion of the golf club head 100 between the top portion 130 and the bottom portion 140 excluding the front portion 170 and extending across a periphery of the golf club head 100 from the toe portion 150, around the rear portion 180, and to the heel portion 160. The bottom portion 140 may include a transition region 230 and a weight port region 240. For example, the weight port region 240 may be a D-shape region. The weight port region 240 may include a plurality of weight ports 900 (FIG. 9) to receive the plurality of weight portions 120. The front portion 170 may include a face portion 175 to engage a golf ball (not shown). The body portion 110 may also include a hosel portion 165 to receive a shaft (not shown). Alternatively, the body portion 110 may include a bore instead of the hosel portion 165. For example, the body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material.

The golf club head 100 may have a club head volume greater than or equal to 300 cubic centimeters ($cm^3$ or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Each of the first set of weight portions 210, generally shown as 405, 410, 415, 420, 425, 430, and 435 (FIG. 4), may be associated with a first mass. Each of the second set of weight portions 220, generally shown as 440, 445, 450, 455, 460, 465, 470, 475, and 480 (FIG. 4), may be associated with a second mass. The first mass may be greater than the second mass or vice versa. In one example, the first set of weight portions 210 may be made of a tungsten-based material whereas the second set of weight portions 220 may be made of an aluminum-based material. As described in detail below, the first and second set of weight portions 210 and 220, respectively, may provide various weight configurations (e.g., FIGS. 15-18).

Figure 9:
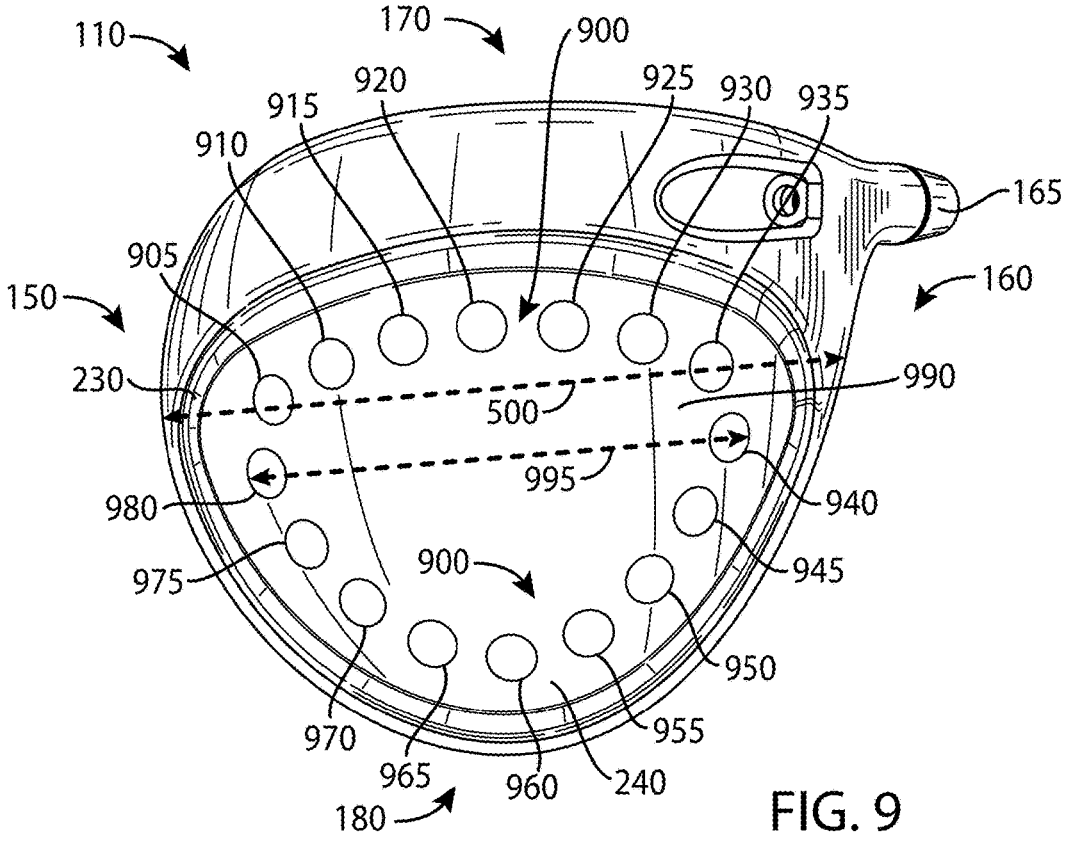
FIG. 9 depicts a bottom view of an example body portion of the example golf club head of FIG. 1.
Figure 10:
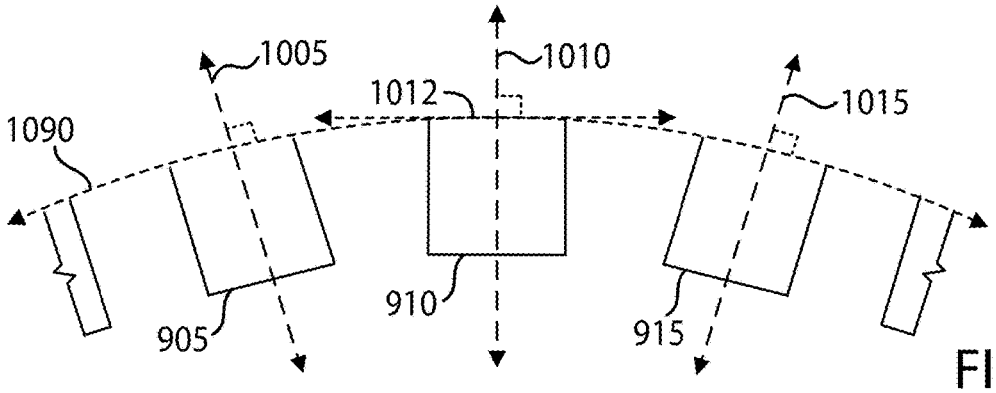
FIG. 10 depicts a cross-sectional view of the example body portion of the example golf club head of FIG. 1.
Figure 11:
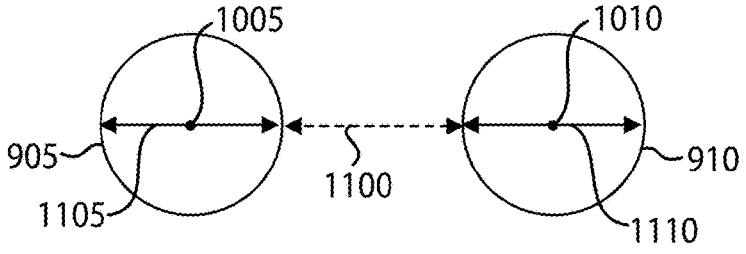
FIG. 11 depicts two weight ports of the example golf club head of FIG. 1.

Referring to FIGS. 9-11, for example, the bottom portion 140 of the body portion 110 may include a plurality of weight ports 900. The plurality of weight ports 900, generally shown as 905, 910, 915, 920, 925, 930, 935, 940, 945, 950, 955, 960, 965, 970, 975, and 980, may be located along a periphery of the weight port region 240 of the bottom portion 140. The plurality of weight ports 900 may extend across the bottom portion 140. In particular, the plurality of weight ports 900 may extend between the toe and heel portions 150 and 160, respectively, across the bottom portion 140. The plurality of weight ports 900 may also extend between the front and rear portions 170 and 180, respectively, across the bottom portion 140. The plurality of weight ports 900 may be arranged across the bottom portion 140 along a path that defines a generally D-shaped loop. In one example, the plurality of weight ports 900 may extend more than 50% of a maximum toe-to-heel distance 500 between of the toe and heel portions 150 and 160, respectively, across the bottom portion 140. The maximum toe-to-heel distance 500 of the golf club head 100 may be measured from transition regions between the top and bottom portions 130 and 140, respectively, at the toe and heel portions 150 and 160, respectively. Alternatively, the maximum toe-to-heel distance 500 may be a horizontal distance between vertical projections of the outermost points of the toe and heel portions 150 and 160, respectively. For example, the maximum toe-to-heel distance 500 may be measured when the golf club head 100 is at a lie angle 510 of about 60 degrees. If the outermost point of the heel portion 160 is not readily defined, the outermost point of the heel portion 160 may be located at a height 520 of about 0.875 inches (22.23 millimeters) above a ground plane 530 (i.e., a horizontal plane on which the golf club head 100 is lying on). In one example, the maximum toe-to-heel distance 500 may be no more than 5 inches (127 millimeters). Accordingly, the plurality of weight ports 900 may extend at least 2.5 inches between the toe and heel portions 150 and 160, respectively. A maximum toe-to-heel distance 995 of the plurality of weight ports 900 may extend between the weight ports 940 and 980. For example, the maximum toe-to-heel distance 995 of the plurality of weight ports 900 may be about 3.7 inches. As the rules of golf may change from time to time (e.g., new regulations may be adopted or old rules may be eliminated or modified by golf standard organizations and/or governing bodies), the lie angle 510 and/or the height 520 for measuring the maximum toe-to-heel distance 500 may also change. The apparatus, methods, and articles of manufacture described herein are not limited in this regard.

Each of the plurality of weight ports 900 may be associated with a port diameter ($D_{port}$) (e.g., two shown as 1105 and 1110 in FIG. 11). For example, the port diameter of each weight port of the plurality of weight ports 900 may be about 0.3 inch (7.65 millimeters). Alternatively, the port diameters of adjacent weight ports may be different. In one example, the weight port 905 may be associated with a port diameter 1105, and the weight port 910 may be associated with a port diameter 1110. In particular, the port diameter 1105 of the weight port 905 may be larger than the port diameter 1110 of the weight port 910 or vice versa. The apparatus, methods, and articles of manufacture described herein are not limited in this regard.

The bottom portion 140 may also include an outer surface 990. As illustrated in FIG. 10, for example, the plurality of weight ports 900 may be formed on the bottom portion 140 relative to an outer surface curve 1090 formed by the outer surface 990. In particular, each of the plurality of weight ports 900 may be associated with a port axis generally shown as 1005, 1010, and 1015. A center of a weight port may define the port axis of the weight port. Each port axis may be perpendicular or substantially perpendicular to a plane that is tangent to the outer surface curve 1090 at the point of intersection of the port axis and the outer surface curve 1090. In one example, substantially perpendicular may refer to a deviation of ±5° from perpendicular. In another example, substantially perpendicular may refer to a deviation of ±3° from perpendicular. The deviation from perpendicular may depend on manufacturing tolerances.

In one example, the port axis 1010 may be perpendicular or substantially perpendicular (i.e., normal) to a tangent plane 1012 of the outer surface curve 1090. Multiple fixtures may be used to manufacture the plurality of weight ports 900 by positioning the golf club head 100 in various positions. Alternatively, the weight ports may be manufactured by multiple-axis machining processes, which may be able to rotate the golf club head around multiple axes to mill away excess material (e.g., by water jet cutting and/or laser cutting) to form the plurality of weight ports 900. Further, multiple-axis machining processes may provide a suitable surface finish because the milling tool may be moved tangentially about a surface. Accordingly, the apparatus, methods, and articles of manufacture described herein may use a multiple-axis machining process to form each of the plurality of weight ports 900 on the bottom portion 140. For example, a five-axis milling machine may form the plurality of weight ports 900 so that the port axis 1000 of each of the plurality weight ports 900 may be perpendicular or substantially perpendicular to the outer surface curve 1090. The tool of the five-axis milling machine may be moved tangentially about the outer surface curve 1090 of the outer surface 990.

Turning to FIG. 11, for example, two adjacent weight ports may be separated by a port distance 1100, which may be the shortest distance between two adjacent weight ports on the outer surface 990. In particular, the port distance 1100 may be less than or equal to the port diameter of any of the two adjacent weight ports. In one example, the port distance 1100 between the weight ports 905 and 910 may be less than or equal to either the port diameter 1105 or the port diameter 1110. The apparatus, methods, and articles of manufacture described herein are not limited in this regard.

The plurality of weight portions 120 may have similar or different physical properties (e.g., density, shape, mass, volume, size, color, etc.). In one example, the first set of weight portions 210 may be a black color whereas the second set of weight portions 220 may be a gray color or a steel color. Some or all of the plurality of weight portions 120 may be partially or entirely made of a metal material such as a steel-based material, a tungsten-based material, an aluminum-based material, any combination thereof or suitable types of materials. Alternatively, some or all of the plurality of weight portions 120 may be partially or entirely made of a non-metal material (e.g., composite, plastic, etc.).

Figure 12:
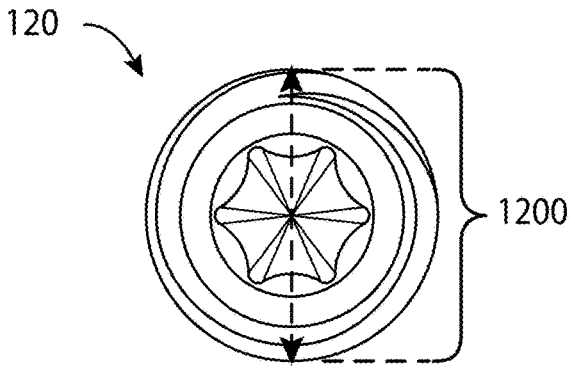
FIG. 12 depicts a top view of an example weight portion of the example golf club head of FIG. 1.
Figure 13:
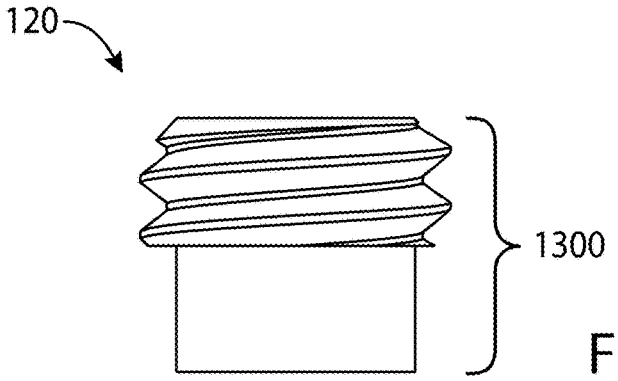
FIG. 13 depicts a side view of the example weight portion of FIG. 10.

In the illustrated example as shown in FIGS. 12 and 13, each weight portion of the plurality of weight portions 120 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). Each weight portion of the plurality of weight portions 120 may be associated with a diameter 1200 and a height 1300. In one example, each weight portion of the plurality of weight portions 120 may have a diameter of about 0.3 inch (7.62 millimeters) and a height of about 0.2 inch (5.08 millimeters). Alternatively, the first and second sets of weight portions 210 and 220, respectively, may be different in width and/or height.

Instead of a rear-to-front direction as in other golf club heads, each weight portion of the plurality of weight portions 120 may engage one of the plurality of weight ports 400 in a bottom-to-top direction. The plurality of weight portions 120 may include threads to secure in the weight ports. For example, each weight portion of the plurality of weight portions 120 may be a screw. The plurality of weight portions 120 may not be readily removable from the body portion 110 with or without a tool. Alternatively, the plurality of weight portions 120 may be readily removable (e.g., with a tool) so that a relatively heavier or lighter weight portion may replace one or more of the plurality of weight portions 120. In another example, the plurality of weight portions 120 may be secured in the weight ports of the body portion 110 with epoxy or adhesive so that the plurality of weight portions 120 may not be readily removable. In yet another example, the plurality of weight portions 120 may be secured in the weight ports of the body portion 110 with both epoxy and threads so that the plurality of weight portions 120 may not be readily removable. The apparatus, methods, and articles of manufacture described herein are not limited in this regard.

Figure 14:
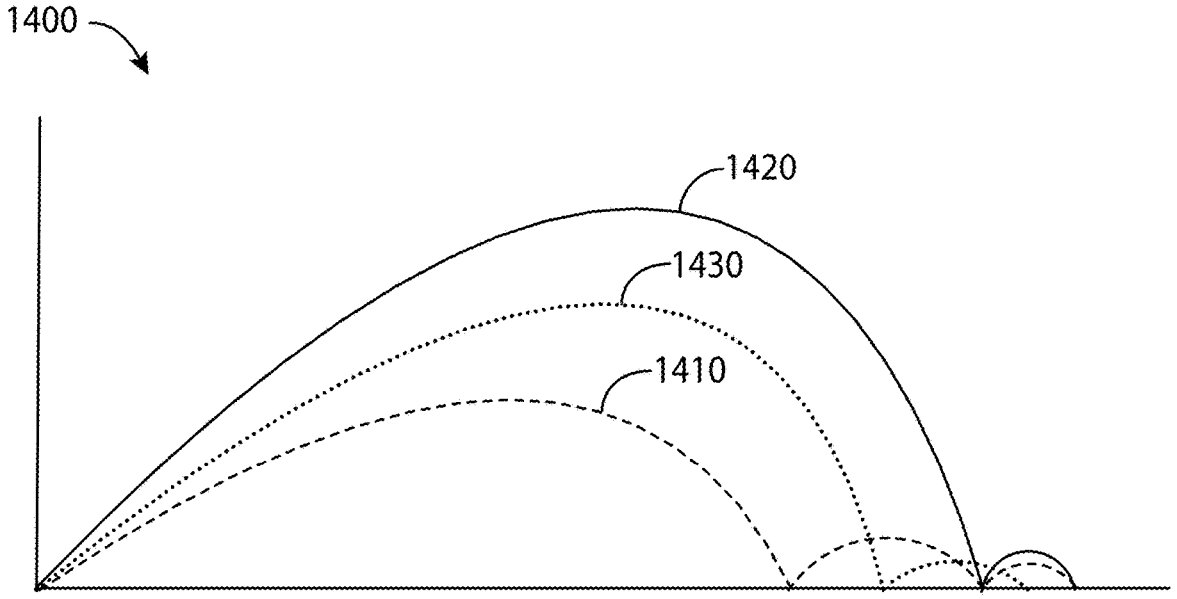
FIG. 14 depicts example launch trajectory profiles of the example golf club head of FIG. 1.
Figure 15:
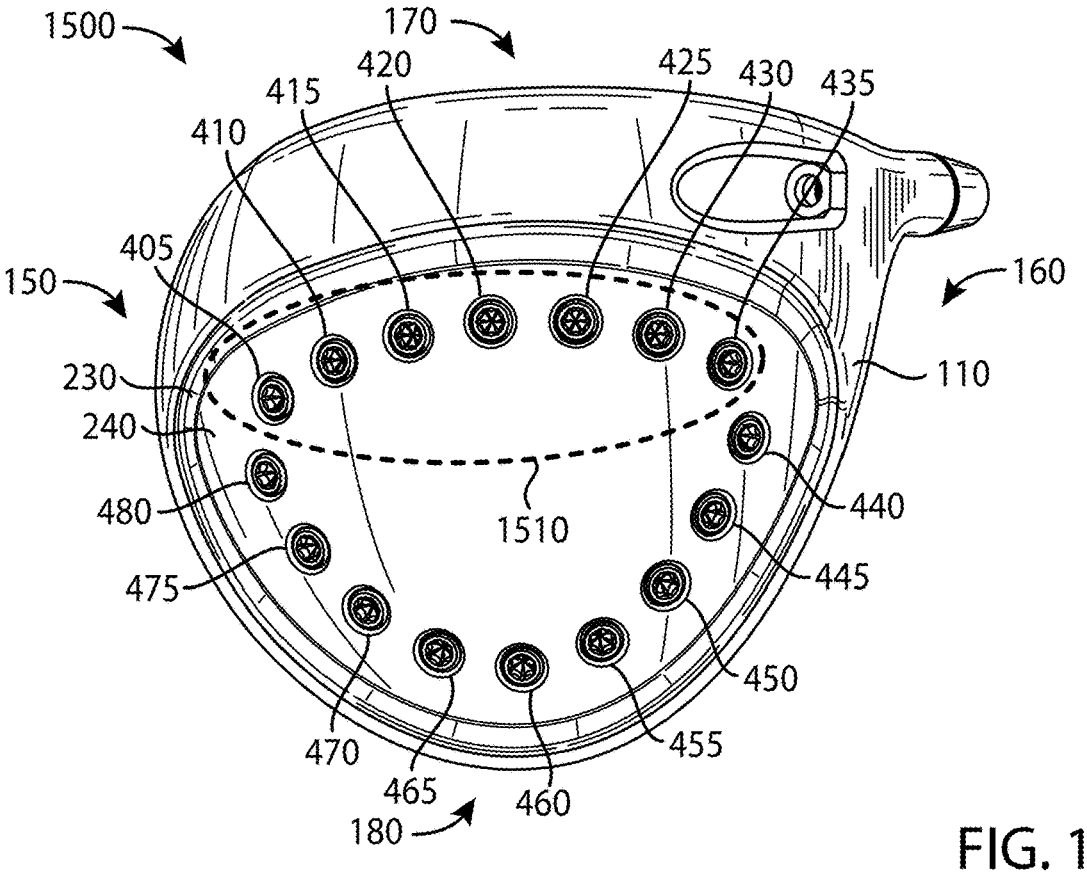
FIG. 15 depicts a first weight configuration of the example weight portions.

In contrast to other golf club heads, the golf club head 100 may accommodate at least four different types of golf swings. As illustrated in FIG. 14, for example, each weight configuration may be associated with one of the plurality of launch trajectory profiles 1400, generally shown as 1410, 1420, and 1430. Referring to FIG. 15, for example, a first weight configuration 1500 may be associated with a configuration of a first set of weight ports 1510. The first set of weight ports 1510 may be located at or proximate to the front portion 170 (e.g., weight ports 905, 910, 915, 920, 925, 930, and 935 shown in FIG. 9). In the first weight configuration 1500, a first set of weight portions may be disposed toward the front portion 170 according to the configuration of the first set of weight ports 1510, whereas a second set of weight portions may be disposed toward the rear portion 180. In particular, the first set of weight portions may form a cluster according to the configuration of the first set of weight ports 1510 at or proximate to the front portion 170. The weight portions 405, 410, 415, 420, 425, 430, and 435 may define the first set of weight portions and may be disposed in weight ports 905, 910, 915, 920, 925, 930, and 935, respectively. The weight portions 440, 445, 450, 455, 460, 465, 470, 475, and 480 may define the second set of weight portions and may be disposed in weight ports 940, 945, 950, 955, 960, 965, 970, 975, and 980, respectively. The first weight configuration 1500 may be associated with the first launch trajectory profile 1410 (FIG. 14). In particular, the first weight configuration 1500 may decrease spin rate of a golf ball. By placing relatively heavier weight portions (i.e., the first set of weight portions) towards the front portion 170 of the golf club head 100 according to the configuration of the first set of weight ports 1510, the center of gravity (GC) of the golf club head 100 may move relatively forward and lower to produce a relatively lower launch and spin trajectory. As a result, the first launch trajectory profile 1410 may be associated with a relatively greater roll distance (i.e., distance after impact with the ground). While the above example may describe the weight portions being disposed in certain weight ports, any weight portion of the first set of weight portions 210 may be disposed in any weight port of the first set of weight ports 1510.

Figure 16:
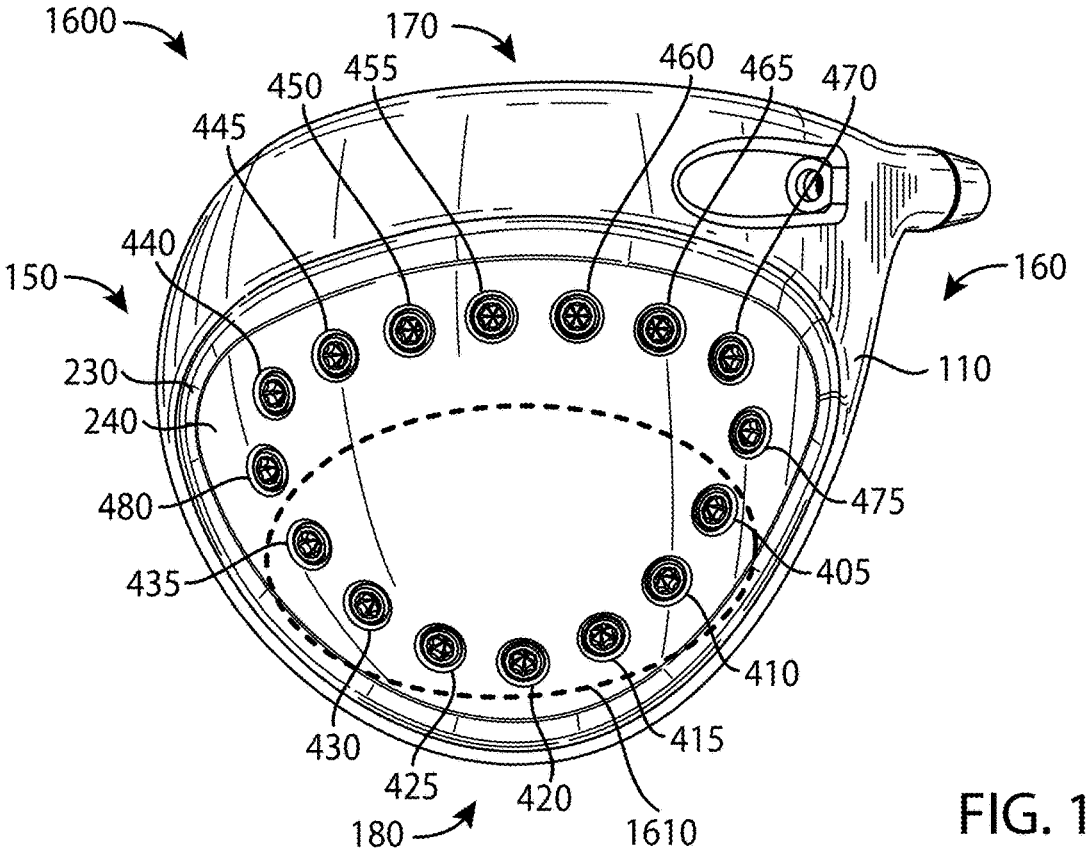
FIG. 16 depicts a second weight configuration of the example weight portions.

Turning to FIG. 16, for example, a second weight configuration 1600 may be associated with a configuration of a second set of weight ports 1610. The second set of weight ports 1610 may be located at or proximate to the rear portion 180 (e.g., weight ports, 945, 950, 955, 960, 965, 970, and 975 shown in FIG. 9). In a second weight configuration 1600 as illustrated in FIG. 16, for example, a first set of weight portions may be disposed toward the rear portion 180 whereas a second set of weight portions may be disposed toward the front portion 170. In particular, the first set of weight portions may form a cluster 1610 at or proximate to the rear portion 180 according to the configuration of the second set of weight ports 1610. The weight portions 405, 410, 415, 420, 425, 430, and 435 may define the first set of weight portions and may be disposed in weight ports 945, 950, 955, 960, 965, 970, and 975, respectively. The weight portions 440, 445, 450, 455, 460, 465, 470, 475, and 480 may define the second set of weight portions and may be disposed in weight ports 905, 910, 915, 920, 925, 930, 935, 940, and 980, respectively. The second weight configuration 1600 may be associated with the second launch trajectory profile 1420 (FIG. 14). In particular, the second weight configuration 1600 may increase launch angle of a golf ball and maximize forgiveness. By placing the relatively heavier weight portion (i.e., the first set of weight portions) towards the rear portion 180 of the golf club head 100 according to the configuration of the second set of weight ports 1610, the center of gravity (GC) of the golf club head 100 may move relatively back and up to produce a relatively higher launch and spin trajectory. Further, the moment of inertia (MOI) of the golf club head 100 may increase in both the horizontal (front-to-back axis) and vertical axes (top-to-bottom axis), which in turn, provides relatively more forgiveness on off-center hits. As a result, the second launch trajectory profile 1420 may be associated with a relatively greater carry distance (i.e., in-the-air distance).

Figure 17:
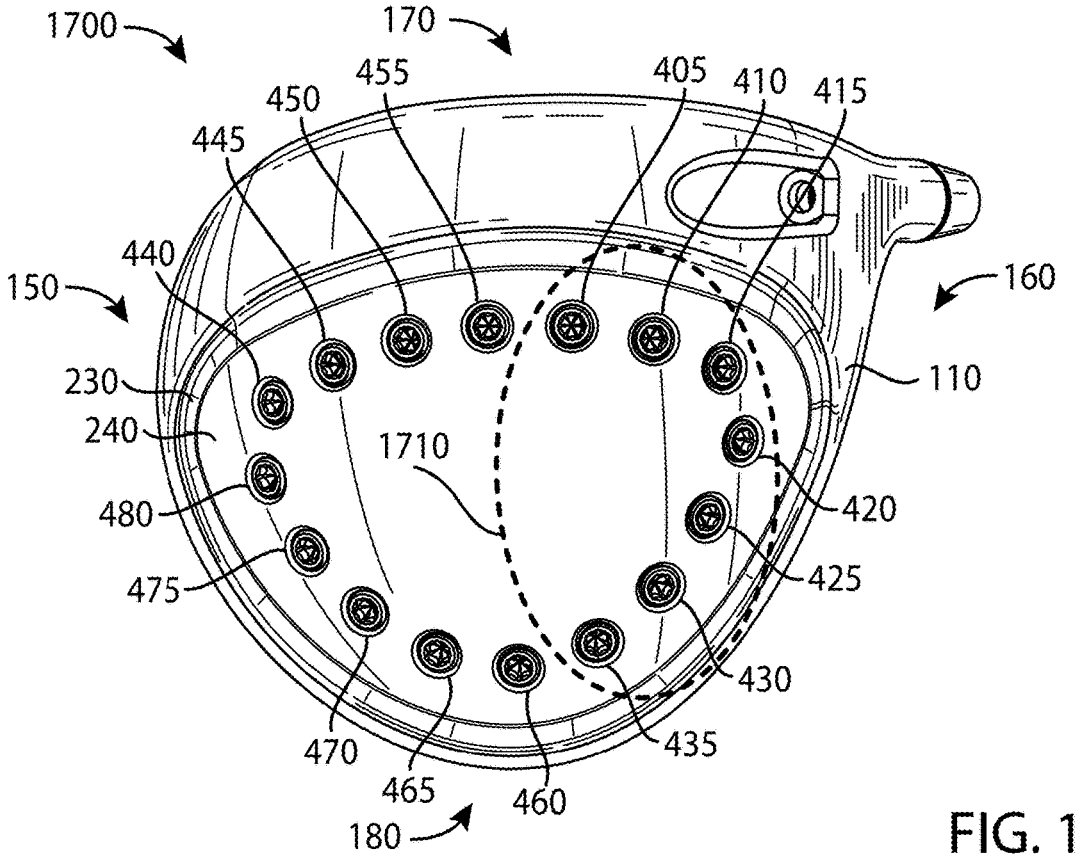
FIG. 17 depicts a third weight configuration of the example weight portions.

Turning to FIG. 17, for example, a third weight configuration 1700 may be associated with a configuration of a third set of weight ports 1710. In the third weight configuration 1700, for example, a first set of weight portions may be disposed toward the heel portion 160 whereas a second set of weight portions may be disposed toward the toe portion 150. In particular, the first set of weight portions may form a cluster of weight portions at or proximate to the heel portion 160 according to the configuration of the third set of weight ports 1710. The weight portions 405, 410, 415, 420, 425, 430, and 435 may define the first set of weight portions and may be disposed in weight ports 925, 930, 935, 940, 945, 950, and 955, respectively. The weight portions 440, 445, 450, 455, 460, 465, 470, 475, and 480 may define the second set of weight portions and may be disposed in weight ports 905, 910, 915, 920, 960, 965, 970, 975, and 980, respectively. The third weight configuration 1700 may be associated with a third launch trajectory profile 1430 (FIG. 14). In particular, the third weight configuration 1700 may allow an individual to turn over the golf club head 100 relatively easier (i.e., square up the face portion 175 to impact a golf ball). By placing the relatively heavier weight portions (i.e., the first set of weight portions) towards the heel portion 160 of the golf club head 100, the center of gravity (GC) of the golf club head 100 may move relatively closer to the axis of the shaft.

Figure 18:
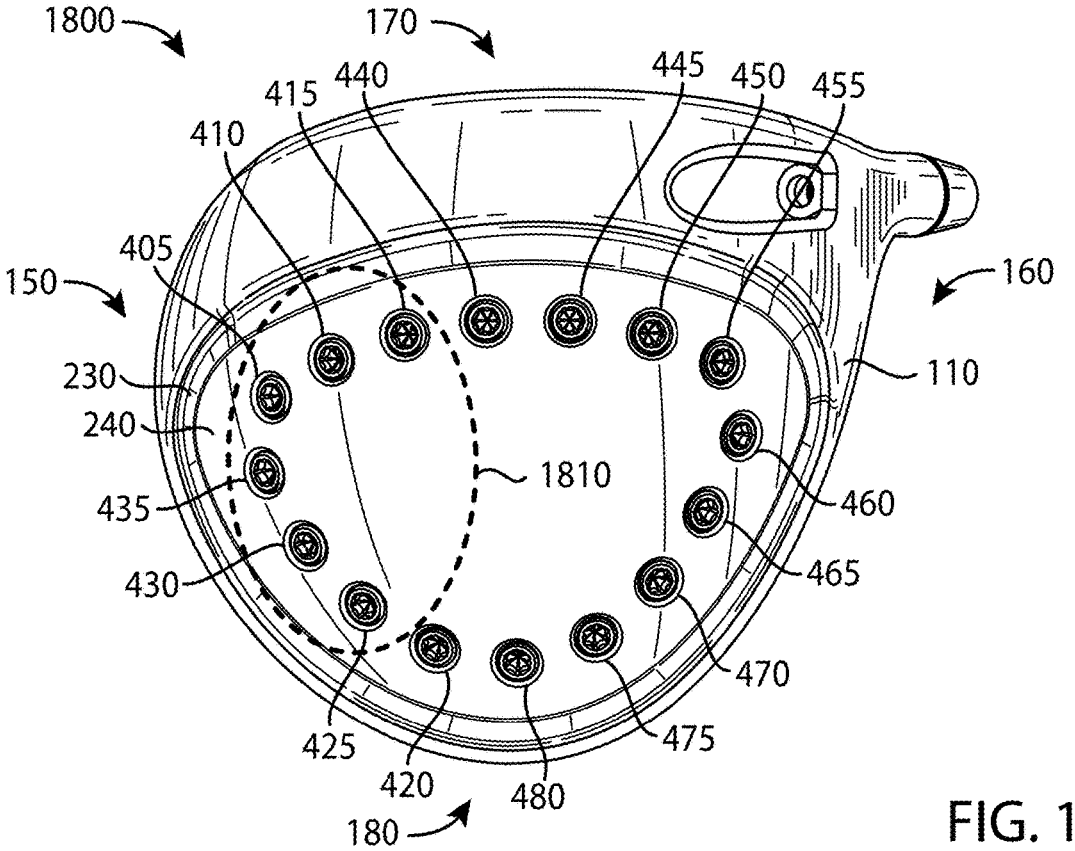
FIG. 18 depicts a fourth weight configuration of the example weight portions.
Figure 19:
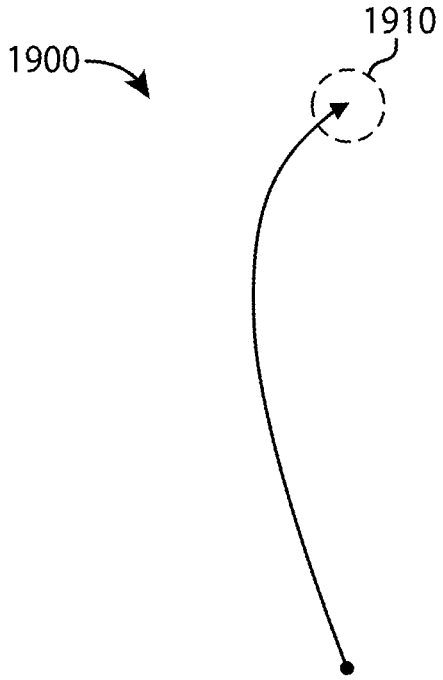
FIG. 19 depicts an example launch trajectory profile of the example golf club head of FIG. 18.

Turning to FIG. 18, for example, a fourth weight configuration 1800 may be associated with a configuration of a fourth set of weight ports 1810. In a fourth weight configuration 1800, for example, a first set of weight portions may be disposed toward the toe portion 150 whereas a second set of weight portions may be disposed toward the heel portion 160. In particular, the first set of weight portions may form a cluster of weight portions at or proximate to the toe portion 150 according to the configuration of the fourth set of weight ports 1810. The weight portions 405, 410, 415, 420, 425, 430, and 435 may define the first set of weight portions and may be disposed in weight ports 905, 910, 915, 965, 970, 975, and 980, respectively. The weight portions 440, 445, 450, 455, 460, 465, 470, 475, and 480 may define the second set of weight portions and may be disposed in weight ports 920, 925, 930, 935, 940, 945, 950, 955, and 960, respectively. The fourth weight configuration 1800 may be associated with the third launch trajectory profile 1430 (FIG. 14). In particular, the fourth weight configuration 1800 may prevent an individual from turning over the golf club head 100 (i.e., the face portion 175 may be more open to impact a golf ball). By placing the relatively heavier weight portions (i.e., the first set of weight portions) towards the toe portion 150 of the golf club head 100, the center of gravity (GC) of the golf club head 100 may move relatively farther away from the axis of the shaft. The fourth weight configuration 1800 may result in a fade golf shot (as shown in FIG. 19, for example, a trajectory or ball flight in which a golf ball travels to the left of a target 1910 and curving back to the right of the target for a right-handed individual). The apparatus, methods, and articles of manufacture described herein are not limited in this regard.

Figure 20:
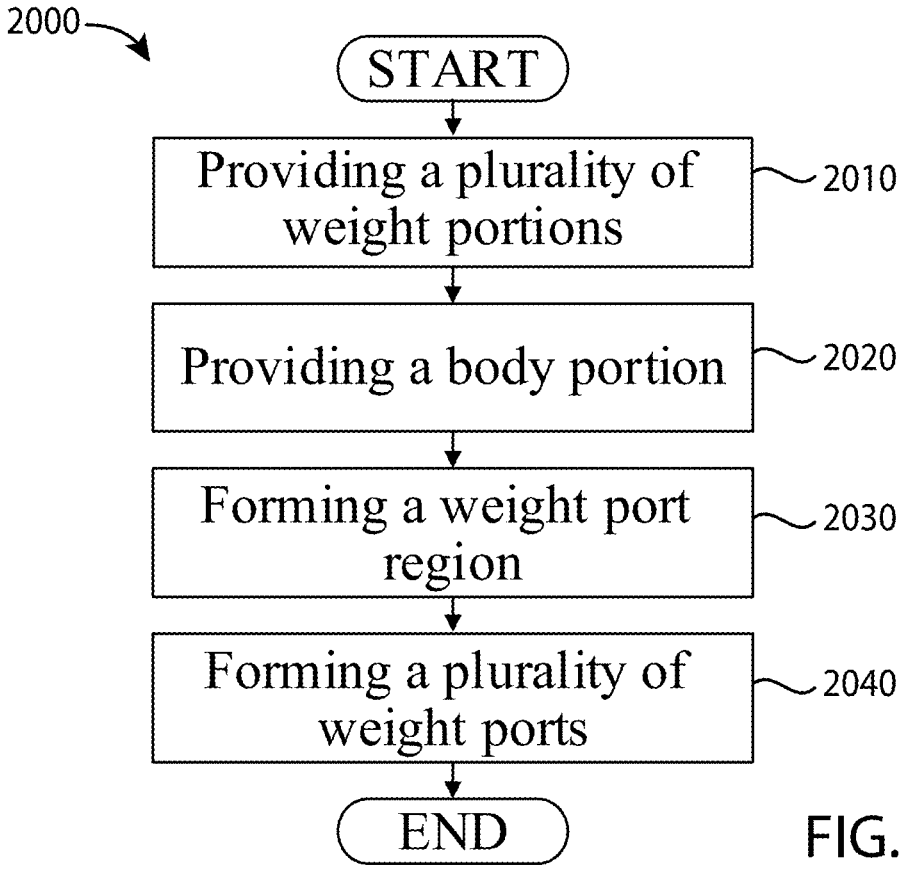
FIG. 20 depicts one manner in which the example golf club heads described herein may be manufactured.

FIG. 20 depicts one manner in which the golf club head 100 may be manufactured. In the example of FIG. 20, the process 2000 may begin with providing a plurality of weight portions (block 2010). The plurality of weight portions may include a first set of weight portions and a second set of weight portions. Each weight portion of the first set of weight portions may be associated with a first mass whereas each weight portion of the second set of weight portions may be associated with a second mass. The first mass may be greater than the second mass. In one example, each weight portion of the first set of weight portions may be made of a tungsten-based material with a mass 2.6 grams whereas each weight portion of the second set of weight portions may be made of an aluminum-based material with a mass of 0.4 grams. The first set of weight portions may have a gray color or a steel color whereas the second set of weight portions may have a black color.

The process 2000 may provide a body portion of a golf club head (block 2020). The body portion may include a front portion, a rear portion, a toe portion, a heel portion, a top portion, a bottom portion having an outer surface associated with outer surface curve, and a skirt portion between the top and bottom portion.

The process 2000 may form a weight port region located at or proximate to the bottom and skirts portions (block 2030). A transition region may surround the weight port region.

The process 2000 may form a plurality of weight ports along a periphery of the weight port region (block 2040). Each weight port of the plurality of weight ports may be associated with a port diameter and configured to receive at least one weight portion of the plurality of weight portions. Two adjacent weight ports may be separated by less than or equal to the port diameter. Further, each weight port of the plurality of weight ports may be associated with a port axis. The port axis may be perpendicular or substantially perpendicular relative to a tangent plane of the outer surface curve of the bottom portion of the golf club head.

The example process 2000 of FIG. 20 is merely provided and described in conjunction with FIGS. 1-19 as an example of one way to manufacture the golf club head 100. While a particular order of actions is illustrated in FIG. 20, these actions may be performed in other temporal sequences. For example, two or more actions depicted in FIG. 20 may be performed sequentially, concurrently, or simultaneously. Although FIG. 20 depicts a particular number of blocks, the process may not perform one or more blocks. The apparatus, methods, and articles of manufacture described herein are not limited in this regard.

Figure 4:
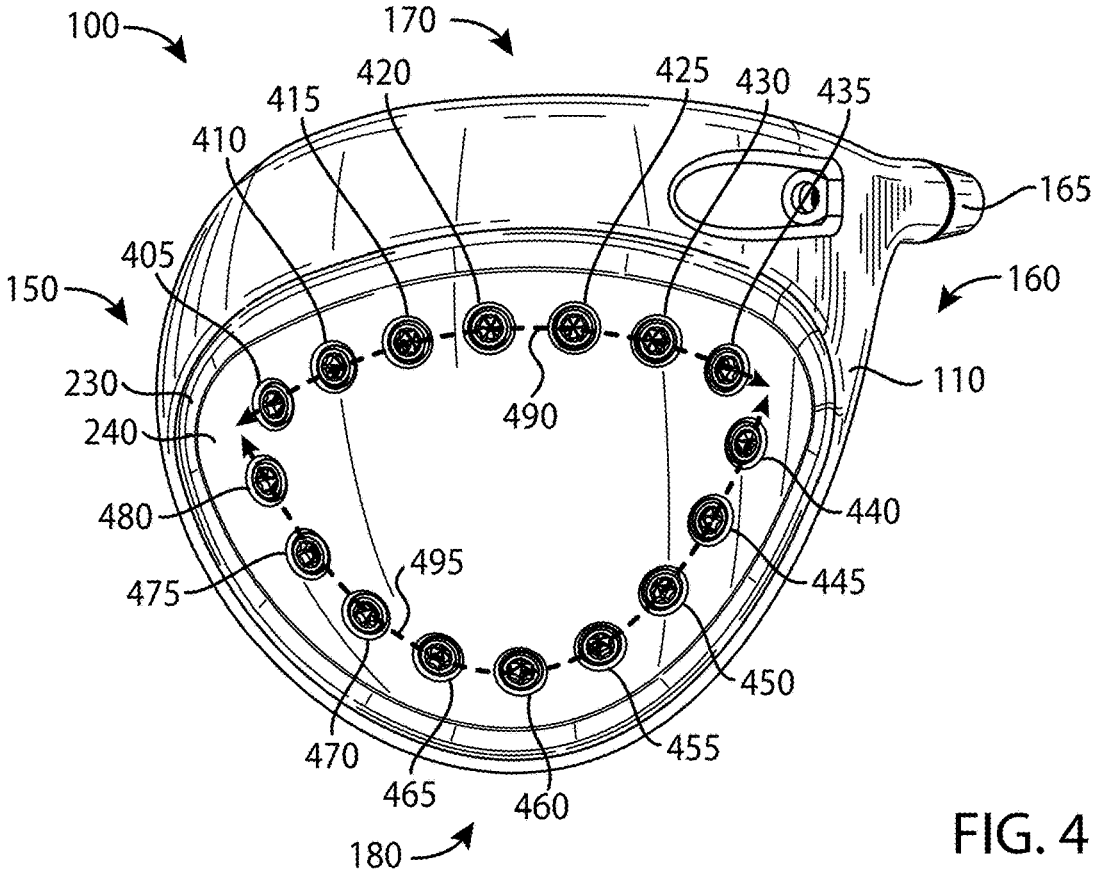
FIG. 4 depicts a bottom view of the example golf club head of FIG. 1.
Figure 5:
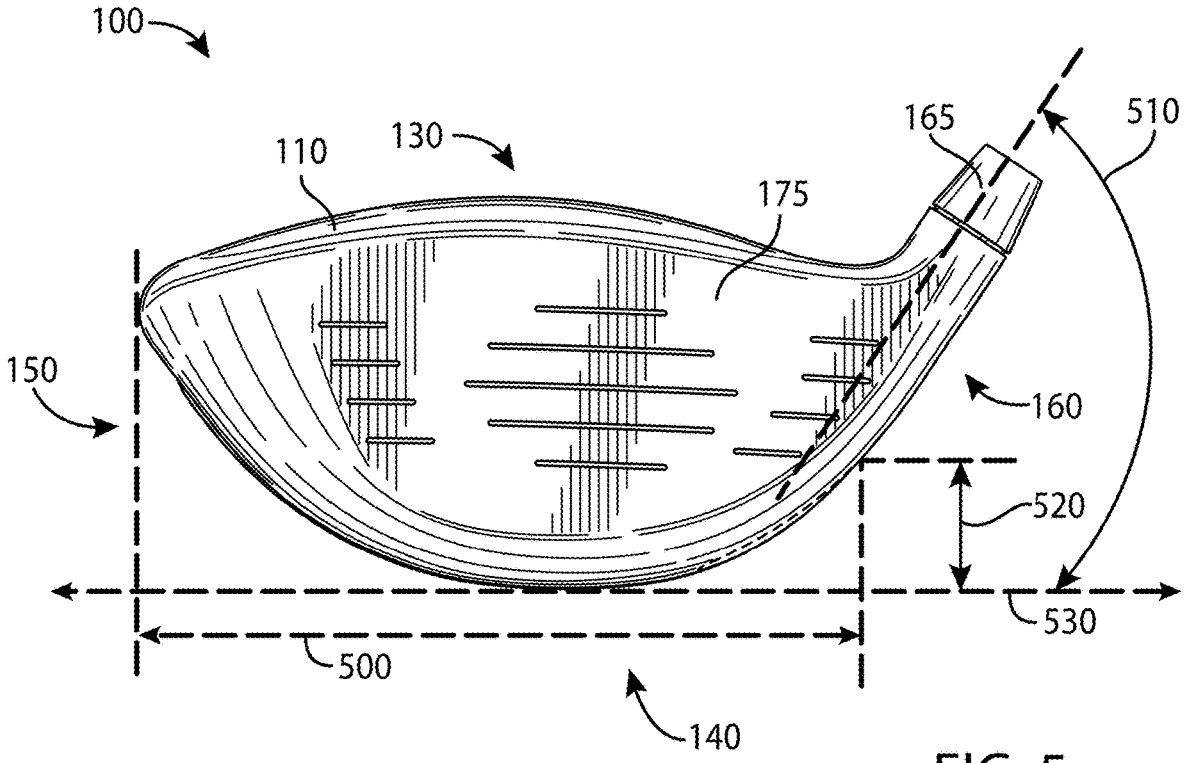
FIG. 5 depicts a front view of the example golf club head of FIG. 1.
Figure 6:
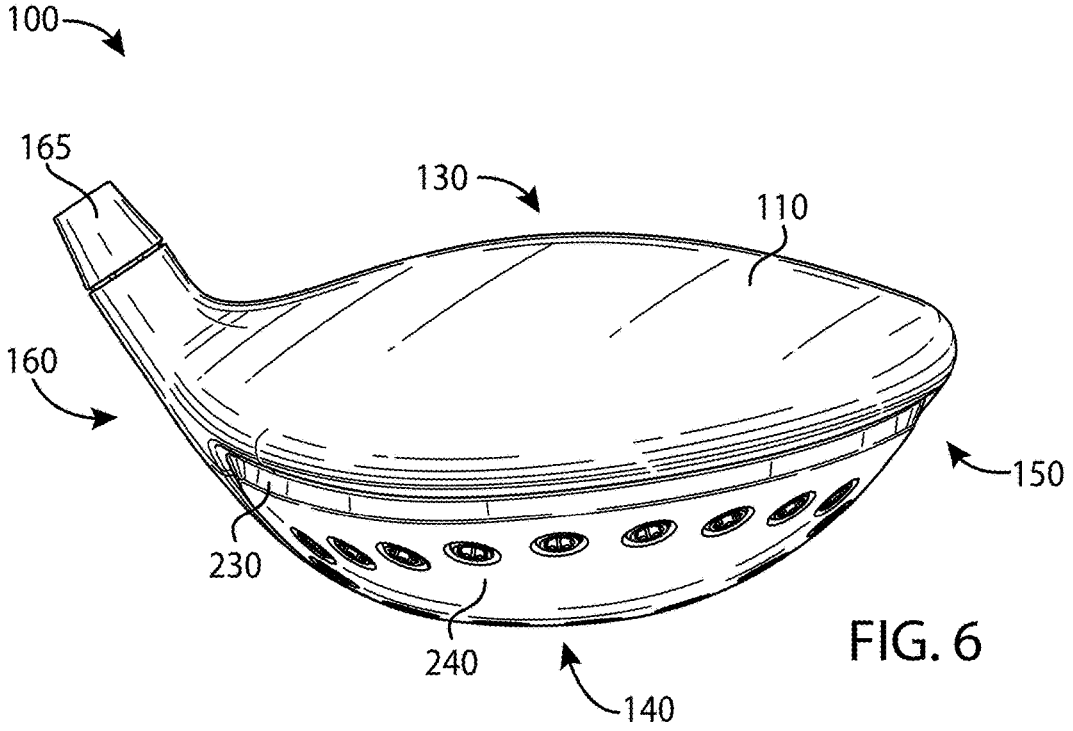
FIG. 6 depicts a rear view of the example golf club head of FIG. 1.
Figure 7:
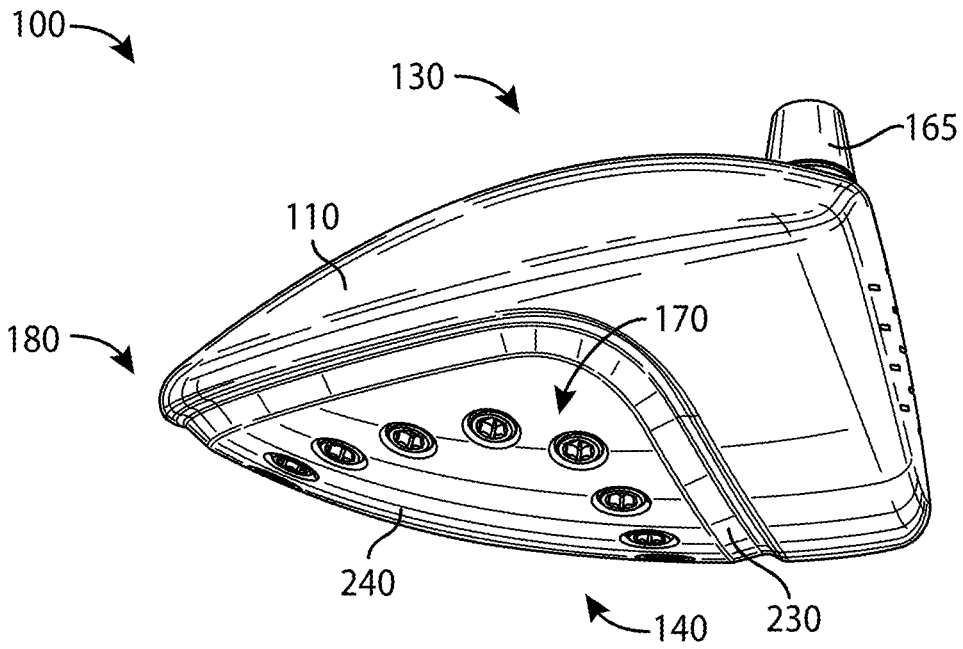
FIG. 7 depicts a toe view of the example golf club head of FIG. 1.
Figure 8:
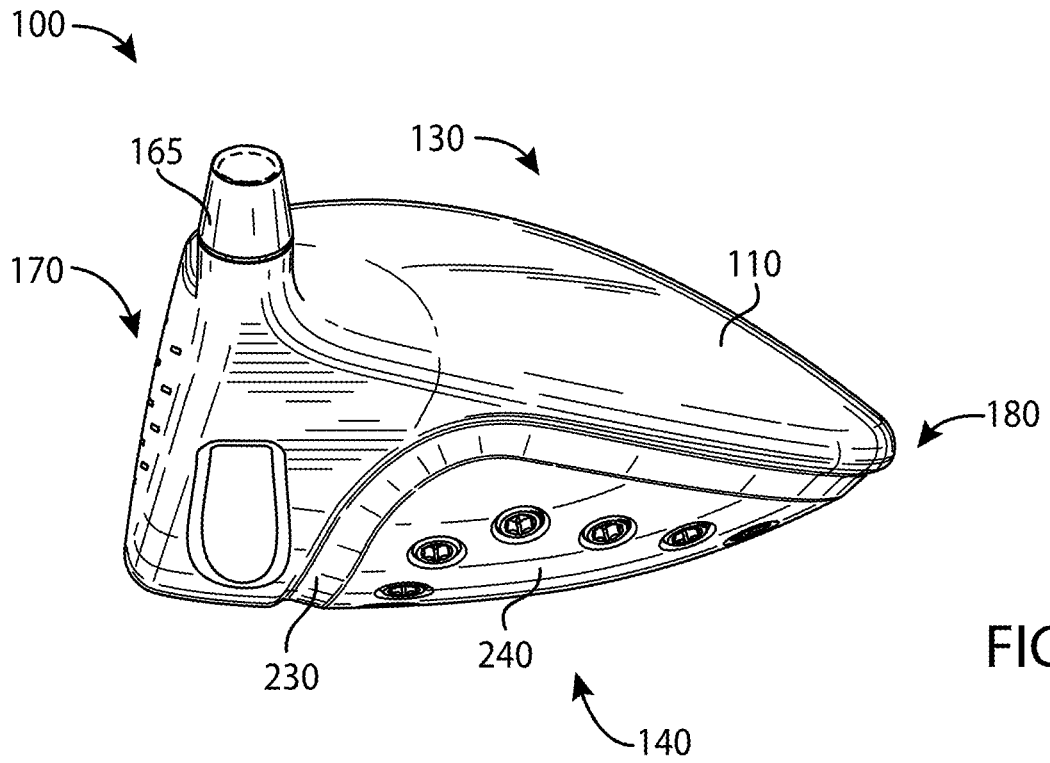
FIG. 8 depicts a heel view of the example golf club head of FIG. 1.

As shown in the above examples, the plurality of weight portions 120 and the plurality of weight ports 900 may be located on a periphery of the weight port region 240 along a path that defines a generally D-shaped loop formed with two arcs, generally shown as 490 and 495 in FIG. 4. For example, the weight portions 405, 410, 415, 420, 425, 430, and 435 (FIG. 4), and the weight ports 905, 910, 915, 920, 925, 930, and 935 (FIG. 9) may form the first arc 490. In particular, the first arc 490 may extend between the toe and heel portions 150 and 160, respectively, across the bottom portion 140. The weight portions 440, 445, 450, 455, 460, 465, 470, 475, and 480 (FIG. 4), the weight ports 940, 945, 950, 955, 960, 965, 970, 975, and 980 (FIG. 9) may form the second arc 495. The second arc 495 may generally follow the contour of the rear portion 180 of the body portion 110. Alternatively, the first and second arcs 490 and 495 may define loops with other shapes that extend across the bottom portion 140 (e.g., a generally O-shaped loop). The apparatus, methods, and articles of manufacture described herein are not limited in this regard.

Figure 21:
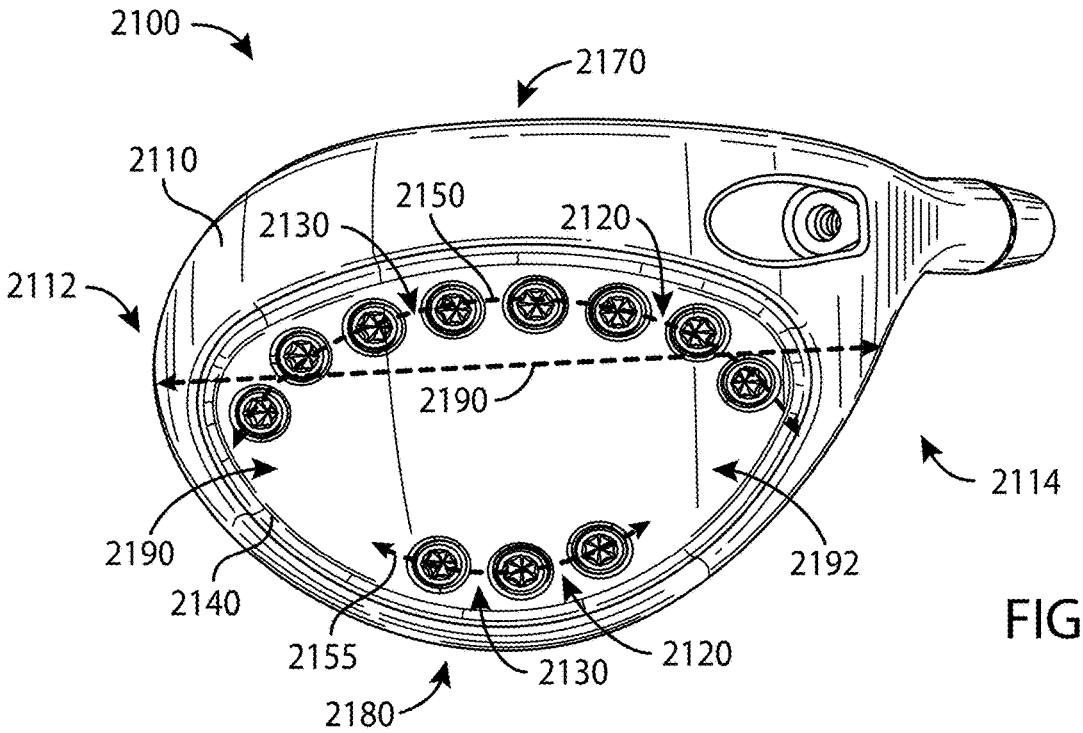
FIG. 21 depicts a bottom view of another example golf club head.

Although the above examples may depict the plurality of weight portions 120 and the plurality of weight ports 900 forming a particular geometric shape, the apparatus, methods, and articles of manufacture described herein may have weight portions and weight ports located along a periphery of a weight portion region to form other geometric shapes. Turning to FIG. 21, for example, a golf club head 2100 may include a bottom portion 2110, and a plurality of weight portions 2120 disposed in a plurality of weight ports 2130. The plurality of weight ports 2130 may be located along a periphery of a weight port region 2140 of the bottom portion 2110 (i.e., the plurality of weight ports 2130 may extend between the toe and heel portions 2112 and 2114, respectively, across the bottom portion 2110). In contrast to the plurality of weight portions 120 and the plurality of weight ports 900 (e.g., FIGS. 4 and 9), the plurality of weight ports 2130 may form two discrete arcs, generally shown as 2150 and 2155, extending across the bottom portion 2110. The plurality of weight ports 2130 may extend more than 50% of a maximum toe-to-heel distance 2190 of the golf club head 2100. The apparatus, methods, and articles of manufacture are not limited in this regard.

Figure 22:
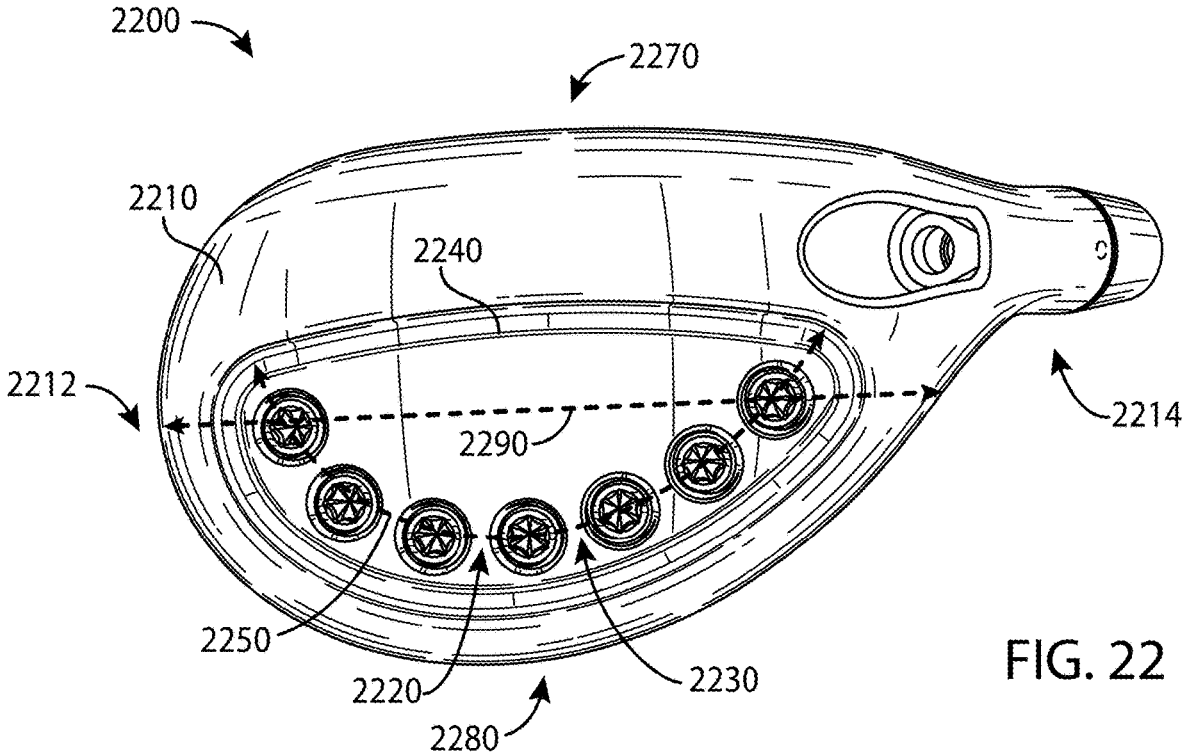
FIG. 22 depicts a bottom view of yet another example golf club head.

As illustrated in FIG. 22, for example, a golf club head 2200 may include a bottom portion 2210, and a plurality of weight portions 2220 disposed in a plurality of weight ports 2230. The plurality of weight ports 2230 located along a periphery of a weight port region 2240 may be arranged along a path that defines an arc, generally shown as 2250, extending across the bottom portion 2210 (i.e., the plurality of weight ports 2230 may extend between the toe and heel portions, 2212 and 2214 across the bottom portion 2210). The plurality of weight ports 2230 may extend more than 50% of a maximum toe-to-heel distance 2290 of the golf club head 2200. The apparatus, methods, and articles of manufacture are not limited in this regard.

Figure 23:
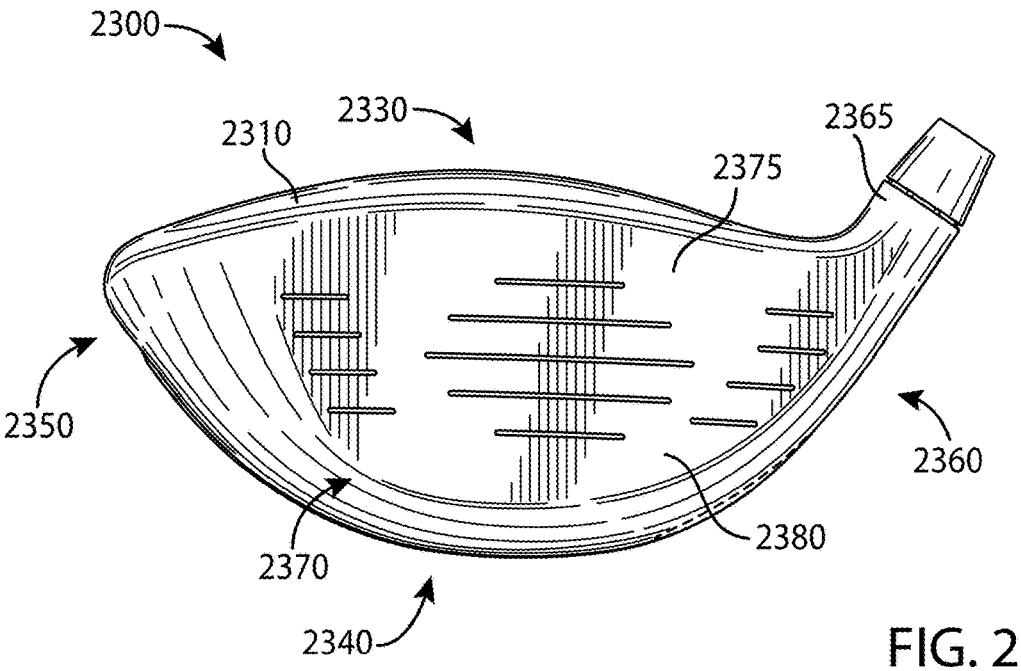
FIG. 23 depicts a front view of yet another example golf club head.
Figure 24:
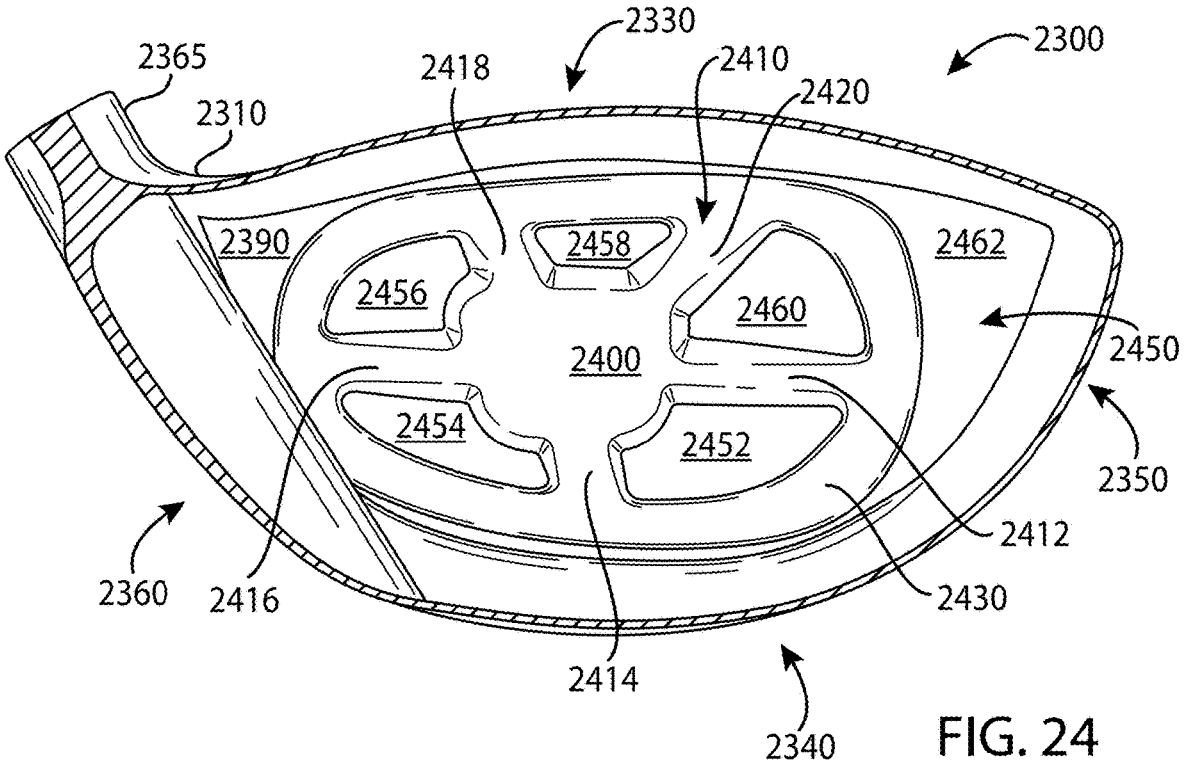
FIG. 24 depicts a cross-sectional view of an example face portion of the example golf club head of FIG. 23.

A golf club head according to the examples described herein may have a face portion with varying thickness or any type of thickness profile. In the example of FIGS. 23 and 24, a golf club head 2300 may include a body portion 2310, which may include a top portion 2330, a bottom portion 2340, a toe portion 2350, a heel portion 2360, a front portion 2370, and a rear portion (not shown). The body portion 2310 may also include a hosel portion 2365 to receive a shaft (not shown). Alternatively, the body portion 2310 may include a bore instead of the hosel portion 2365. The bottom portion 2340 may include one or more weight port regions (not shown), with each weight port region having a plurality of weight ports (not shown) configured to receive a plurality of weight portions (not shown). The weight port regions, weight ports and/or the weight portions may be similar in many respects to the weight port regions, weigh ports, and weight portions described herein (e.g., as described in the above examples). Alternatively, the bottom portion 2340 may not have any weight port regions with weight ports and/or weight portions. The apparatus, methods, and articles of manufacture described herein are not limited in this regard.

The body portion 2310 may be made partially or entirely of an aluminum-based material, a magnesium-type material, a steel-based material, a titanium-based material, any combination thereof, or any other suitable material. In another example the body portion 2310 may be made partially or entirely of a non-metal material such as a ceramic material, a composite material, any combination thereof, or any other suitable material.

The golf club head 2300 may have a club head volume greater than or equal to 300 cubic centimeters ($cm^3$ or cc). In one example, the golf club head 2300 may be about 460 cc. Alternatively, the golf club head 2300 may have a club head volume less than or equal to 300 cc. In particular, the golf club head 2300 may have a club head volume between 100 cc and 200 cc. The club head volume of the golf club head 2300 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2300. Although FIG. 23 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

The front portion 2370 may include a face portion 2375 having an outer side 2380, which may be also the strike face of the face portion 2375, and an inner side 2390. Portions of the face portion 2375 may have constant or varying thicknesses between the top portion 2330 and the bottom portion 2340 and/or between the toe portion 2350 and the heel portion 2360 as described herein. The smallest thickness of the face portion 2375 may be referred to herein as the face portion thickness ($T_{FP}$). In one example, the face portion thickness may be between 0.03 inch (0.762 cm) and 0.12 inch (0.305 cm) ($0.03<T_{FP}<0.12$). In another example, the face portion thickness may be between 0.04 inch (0.102 cm) and 0.1 inch (0.254 cm) ($0.04<T_{FP}<0.1$). In yet another example, the face portion thickness may be between 0.05 inch (0.127 cm) and 0.09 inch (0.229 cm) ($0.05<T_{FP}<0.09$). The apparatus, methods, and articles of manufacture described herein are not limited in this regard.

As illustrated in FIG. 24, for example, the inner side 2390 may include a center portion 2400 having a first thickness ($T_1$), which may be generally defined as the thickness of the face portion 2375 at or near the impact area of the face portion 2375. The impact area of the face portion 2375 may be defined as a central strip down the middle of the face portion 2375 having a width of 1.68 inches (4.27 cm). The center portion 2400 may be within the impact area of the face portion 2375. Accordingly, in one example, the center portion 2400 may have a radius of less than or equal to about 0.84 inch (2.144 cm). The radius of the center portion may refer to the largest distance from a geometric center of the center portion 2400 to the boundary of the center portion 2400 with the center portion having any symmetrical or asymmetrical shape. In another example, the center portion 2400 may have a radius of less than or equal to about 0.7 inch (1.778 cm). In yet another example, the center portion 2400 may have a radius of less than or equal to about 0.6 inch (1.524 cm). In yet another example, the center portion 2400 may have a radius of less than or equal to about 0.5 inch (1.27 cm). In yet another example, the center portion 2400 may have a radius of less than or equal to about 0.4 inch (1.27 cm). In yet another example, the center portion 2400 may have a radius that is generally similar to the radius of a golf ball (not shown). Alternatively, the center portion 2400 may be larger than the impact area. Further, portions of the center portion 2400 may extend outside the impact area while other portions of the center portion 2400 may be within the impact area. The apparatus, methods, and articles of manufacture described herein are not limited in this regard.

The first thickness may be greater than the face portion thickness (T1>TFP). The center portion 2400 may be located generally at impact area of the face portion 2375 or on an area of the face portion 2375 that is used to strike a golf ball (not shown). The center portion 2400 may be offset relative to the geometric center of the face portion 2375 toward the top portion 2330, the bottom portion 2340, the toe portion 2350, or the heel portion 2360. The center portion 2400 may have any shape. For example, the center portion 2400 may be generally one or a combination of a square shape, a rectangular shape, a triangular shape, a circular shape, an elliptical shape, a pentagonal shape, a hexagonal shape, a polygonal shape, or a star shape. The apparatus, methods, and articles of manufacture described herein are not limited in this regard.

The inner side 2390 of the face portion 2375 may include a plurality of inner wall portions 2410, which are generally shown in FIG. 24 as inner wall portions 2412, 2414, 2416, 2418 and 2420. Accordingly, in the example of FIG. 24, the body portion 2310 includes five inner wall portions 2410 (i.e., first to fifth inner wall portions). A wall portion (e.g., inner wall portion or outer wall portion) as described herein may define a portion or a region of the inner side 2390 of the face portion 2375 that projects from the inner side 2390 of the face portion 2375 into the body portion 2310. In other words, a wall portion as described herein may define a portion or a region of the face portion 2375 that has a greater thickness than the face portion thickness ($T_{FP}$). The inner side 2390 may include any number of inner wall portions 2410. The inner wall portions 2410 may extend from the center portion 2400 to an outer wall portion 2430 on the inner side 2390. The inner wall portions 2410 may be connected to the center portion 2400 and/or connected to the outer wall portion 2430. The inner wall portions 2410 may extend from the center portion 2400 to the outer wall portion 2430 in any configuration (i.e., in any orientation, angle, spacing between adjacent inner wall portions, etc.).

For example, the inner wall portion 2412 may extend from the center portion 2400 toward the toe portion 2350. The inner wall portion 2414 may extend from the center portion 2400 toward the bottom portion 2340. The inner wall portion 2416 may extend from the center portion 2400 toward the heel portion 2360. The inner wall portion 2418 may extend from the center portion 2400 toward the top portion 2330 and the heel portion 2360. The inner wall portion 2420 may extend from the center portion 2400 toward the top portion 2330 and the toe portion 2350.

Further, the inner wall portions 2410 may vary in width. In one example, the width of any of the inner wall portions 2410 may be between about 0.1 inch (0.254 cm) and about 0.75 inch (1.905 cm). In another example, the width of any or the inner wall portion 2410 may be between about 0.2 inch (0.508 cm) and about 0.5 inch (1.27 cm). The inner wall portions 2410 may also vary in cross-sectional shape. In one example, one or more of the inner wall portions may have a rectangular cross-sectional shape. In another example, one or more of the inner wall portions may have an elliptical cross-sectional shape. In yet another example, one or more of the inner wall portions may have a trapezoidal cross-section shape. Alternatively, the cross-sectional configuration and/or the width of each inner wall portion may vary between the center portion 2400 and the outer wall portion 2430. The apparatus, methods, and articles of manufacture described herein are not limited in this regard.

The outer wall portion 2430 may have a second thickness ($T_2$) that may be less than the first thickness ($T_2<T_1$) but greater than the face portion thickness ($T_{FP}$). However, the thickness of the outer wall portion 2430 may vary. The second thickness may be generally defined as the thickness of the face portion 2375 at or near the outer wall portion 2430. The outer wall portion 2430 may at least partially surround the center portion 2400. In the example of FIG. 24, the outer wall portion 2430 resembles a loop that surrounds the center portion 2400. In one example, the first thickness may be between about 0.1 inches (0.25 cm) and about 0.2 (0.50 cm) inches ($0.1<T_1<0.2$), and the second thickness may be between 0.05 inches (0.13 cm) and 0.15 inches (0.38 cm). In another example, the first thickness may be between about 0.125 inches (0.32 cm) and about 0.175 inches (0.44 cm), and the second thickness may be between about 0.075 inches (0.19 cm) and about 0.125 inches (0.32 cm). The apparatus, methods, and articles of manufacture described herein are not limited in this regard.

Between the center portion 2400, the inner wall portions 2410 and the outer wall portion 2430, the inner side 2390 of the face portion 2375 may include back portion regions 2450, which are generally shown as back portion regions 2452, 2454, 2456, 2458, 2460, and 2462. Each of the back portion regions 2452, 2454, 2456, 2458, and 2460 may be bound by the center portion 2400, two adjacent inner wall portions 2410 and a corresponding portion of the outer wall portion 2430. The back portion region 2462 may surround the outer wall portion 2430. The back portion regions 2450 may have the same thickness or have different thicknesses. The back portion regions 2450 may have a third thickness ($T_3$), which may be less than the first thickness ($T_3<T_1$) and less than the second thickness ($T_3<T_2$). The third thickness may be generally defined as the thickness of the face portion 2375 at or near the back portion regions 2450. In one example, the thickness of any of the back portion regions 2450 may be the same as the face portion thickness ($T_{FP}$). In one example, the back portion regions 2450 may have a third thickness of between about 0.03 inches (0.762 cm) and about 0.14 inch (0.36 cm). In another example, the back portion regions 2450 may have a third thickness of between about 0.05 inch (0.127 cm) and about 0.12 inches (0.30 cm). In another example, the back portion regions 2450 may have a similar thickness as the face portion thickness. The apparatus, methods, and articles of manufacture described herein are not limited in this regard.

Each of the inner wall portions 2410 may have a constant thickness or variable thickness. In one example, the thickness of each of the inner wall portions 2410 may transition from the first thickness ($T_1$) to the second thickness ($T_2$) in a direction from the center portion 2400 to the outer wall portion 2430 as the inner wall portion 2410 extends from the center portion 2400 to the outer wall portion 2430. Accordingly, the thickness of each inner wall portion 2410 may be similar to the first thickness ($T_1$) at the connection region between the inner wall portion 2410 and the center portion 2400, and the thickness of each inner wall portion 2410 may be similar to the second thickness ($T_2$) at the connection region between the inner wall portion 2410 and the outer wall portion 2430. The apparatus, methods, and articles of manufacture described herein are not limited in this regard.

According to the examples described herein and shown in FIG. 24, the face portion 2375 may include a first region that is also referred to as the center portion 2400 at or proximate to the impact area of the face portion 2375 and has a first thickness $T_1$ that is greater than the face portion thickness. The face portion 2375 may include a second region that is also referred to herein as the outer wall portion 2430, which at least partially surrounds the first region and has a second thickness $T_2$ that is less than the first thickness $T_1$. The face portion 2375 may include a plurality of third regions that are also referred to as the inner wall portions 2410 and have a constant or variable thickness of less than or equal to the first thickness $T_1$ and greater than or equal to the second thickness $T_2$. The face portion 2375 may include a plurality of fourth regions that are also referred to herein as the back portion regions 2450 and have a third thickness $T_3$ of less than the first thickness $T_1$ and the second thickness $T_2$, or alternatively, have a third thickness $T_3$ that is similar to the face portion thickness ($T_{FP}$). The back portion region 2462 may be referred to herein as a fifth region that has the third thickness $T_3$ and surrounds the second region or the outer wall portion 2430. Thus, the face portion 2375 includes a plurality of regions having different thicknesses configured as described herein. The apparatus, methods, and articles of manufacture described herein are not limited in this regard.

Figure 25:
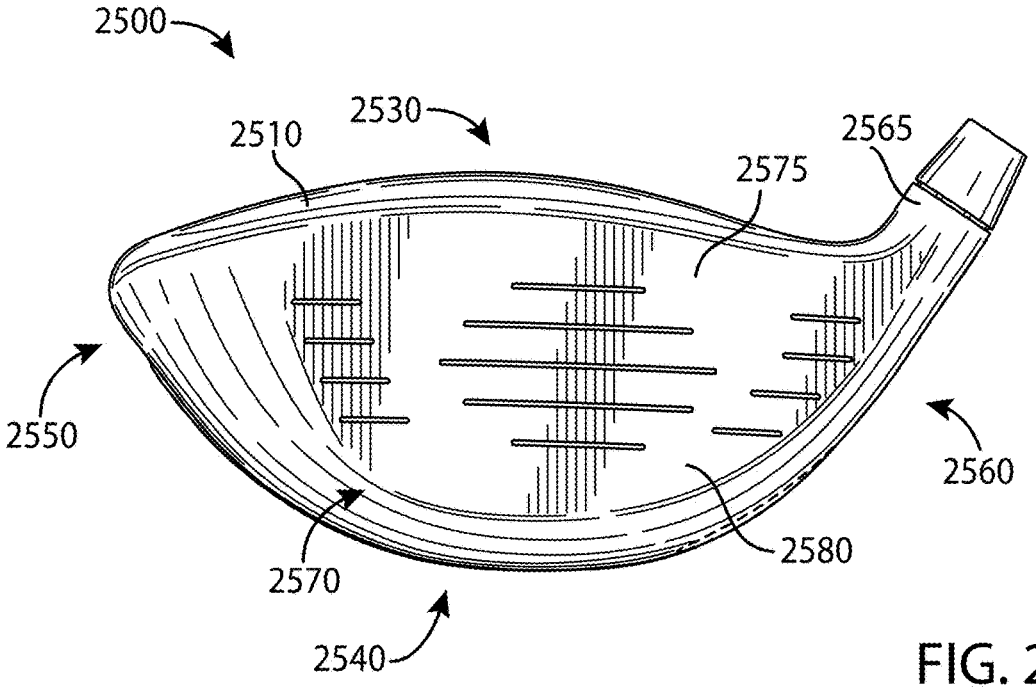
FIG. 25 depicts a front view of another example golf club head.
Figure 26:
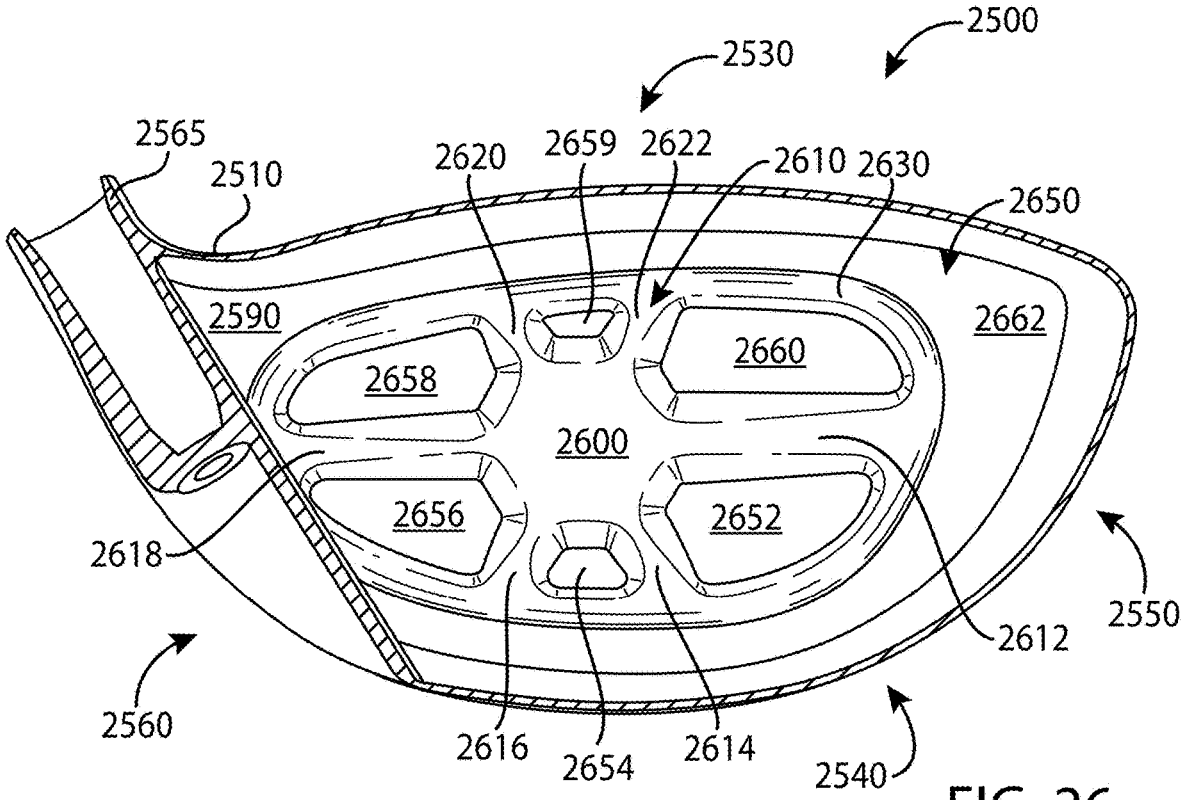
FIG. 26 depicts a cross-sectional view of an example face portion of the example golf club head of FIG. 25.

In the example of FIGS. 25 and 26, a golf club head 2500 may include a body portion 2510, which may include a top portion 2530, a bottom portion 2540, a toe portion 2550, a heel portion 2560, a front portion 2570, and a rear portion (not shown). The body portion 2510 may also include a hosel portion 2565 to receive a shaft (not shown). Alternatively, the body portion 2510 may include a bore instead of the hosel portion 2565. The bottom portion 2540 may include one or more weight port regions (not shown), with each weight port region having a plurality of weight ports (not shown) configured to receive a plurality of weight portions (not shown). The weight port regions, weight ports and/or the weight portions may be similar in many respects to the weight port regions, weigh ports and weight portions described herein (e.g., as described in the above examples). Alternatively, the bottom portion 2540 may not have any weight port regions with weight ports and/or weight portions. The apparatus, methods, and articles of manufacture described herein are not limited in this regard.

The body portion 2510 may be made partially or entirely of an aluminum-based material, a magnesium-type material, a steel-based material, a titanium-based material, any combination thereof, or any other suitable material. In another example the body portion 2510 may be made partially or entirely of a non-metal material such as a ceramic material, a composite material, any combination thereof, or any other suitable material.

The golf club head 2500 may have a club head volume greater than or equal to 300 cubic centimeters ($cm^3$ or cc). In one example, the golf club head 2500 may be about 460 cc. Alternatively, the golf club head 2500 may have a club head volume less than or equal to 300 cc. In particular, the golf club head 2500 may have a club head volume between 100 cc and 200 cc. The club head volume of the golf club head 2500 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2500. Although FIG. 25 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

The front portion 2570 may include a face portion 2575 having an outer side 2580, which may be also the strike face of the face portion 2575, and an inner side 2590. Portions of the face portion 2575 may have constant or varying thicknesses between the top portion 2530 and the bottom portion 2540 and/or between the toe portion 2550 and the heel portion 2560 as described herein. The smallest thickness of the face portion 2575 may be referred to herein as the face portion thickness ($T_{FP}$). In one example, the face portion thickness may be between 0.03 inch (0.762 cm) and 0.12 inch (0.305 cm) ($0.03<T_{FP}<0.12$). In another example, the face portion thickness may be between 0.04 inch (0.102 cm) and 0.1 inch (0.254 cm) ($0.04<T_{FP}<0.1$). In yet another example, the face portion thickness may be between 0.05 inch (0.127 cm) and 0.09 inch (0.229 cm) ($0.05<T_{FP}<0.09$). The apparatus, methods, and articles of manufacture described herein are not limited in this regard.

As illustrated in FIG. 26, for example, the inner side 2590 may include a center portion 2600 having a first thickness ($T_1$), which may be generally defined as the thickness of the face portion 2575 at or near the impact area of the face portion 2575. The impact area of the face portion 2575 may be defined as a central strip down the middle of the face portion 2575 having a width of about 1.68 inches (4.27 cm). The center portion 2400 may be within the impact area of the face portion 2575. Accordingly, in one example, the center portion 2600 may have a radius of less than or equal to about 0.84 inch (2.144 cm). The radius of the center portion may refer to the largest distance from a geometric center of the center portion 2600 to the boundary of the center portion 2600 with the center portion having any symmetrical or asymmetrical shape. In another example, the center portion 2600 may have a radius of less than or equal to about 0.7 inch (1.778 cm). In yet another example, the center portion 2600 may have a radius of less than or equal to about 0.6 inch (1.524 cm). In yet another example, the center portion 2600 may have a radius of less than or equal to about 0.5 inch (1.27 cm). In yet another example, the center portion 2600 may have a radius of less than or equal to about 0.4 inch (1.27 cm). In yet another example, the center portion 2600 may have a radius that is generally similar to the radius of a golf ball (not shown). Alternatively, the center portion 2600 may be larger than the impact area. Further, portions of the center portion 2600 may extend outside the impact area while other portions of the center portion 2600 may be within the impact area. The apparatus, methods, and articles of manufacture described herein are not limited in this regard.

The first thickness may be greater than the face portion thickness ($T_1>T_{FP}$). The center portion 2600 may be located generally at the impact area of the face portion 2575 or on an area of the face portion 2575 that is used to strike a golf ball (not shown). The center portion 2600 may be offset relative to the geometric center of the face portion 2575 toward the top portion 2530, the bottom portion 2540, the toe portion 2550, or the heel portion 2560. The center portion 2600 may have any shape. For example, the center portion 2600 may be generally one or a combination of a square shape, a rectangular shape, a triangular shape, a circular shape, an elliptical shape, a pentagonal shape, a hexagonal shape, a polygonal shape, or a star shape. The apparatus, methods, and articles of manufacture described herein are not limited in this regard.

The inner side 2590 of the face portion 2575 may include a plurality of inner wall portions 2610, which are generally shown in FIG. 26 as inner wall portions 2612, 2614, 2616, 2618, 2620 and 2622. Accordingly, in the example of FIG. 26, the body portion 2510 includes six inner wall portions 2610 (i.e., first to sixth inner wall portions). A wall portion (e.g., inner wall portion or outer wall portion) as described herein may define a portion or a region of the inner side 2590 of the face portion 2575 that projects from the inner side 2590 of the face portion 2575 into the body portion 2510. In other words, a wall portion as described herein may define a portion or a region of the face portion 2575 that has a greater thickness than the face portion thickness. The inner side 2590 may include any number of inner wall portions 2610. The inner wall portions 2610 may extend from the center portion 2600 to an outer wall portion 2630 on the inner side 2590. The inner wall portions 2610 may be connected to the center portion 2600 and/or connected to the outer wall portion 2630. The inner wall portions 2610 may extend from the center portion 2600 to the outer wall portion 2630 in any configuration (i.e., in any orientation, angle, spacing between adjacent inner wall portions, etc.).

For example, the inner wall portion 2612 may extend from the center portion 2600 toward the toe portion 2550. The inner wall portion 2614 may extend from the center portion 2600 toward the bottom portion 2540 and the toe portion 2550. The inner wall portion 2616 may extend from the center portion 2600 toward the bottom portion 2540 and the heel portion 2560. The inner wall portion 2618 may extend from the center portion 2600 toward the heel portion 2560. The inner wall portion 2620 may extend from the center portion 2600 toward the top portion 2530 and the heel portion 2560. The inner wall portion 2622 may extend from the center portion 2600 toward the top portion 2530 and the toe portion 2550.

Further, the inner wall portions 2610 may vary in width. In one example, the width of any of the inner wall portions 2610 may be between about 0.1 inch (0.254 cm) and about 0.75 inch (1.905). In another example, the width of any or the inner wall portion 2610 may be between about 0.2 inch (0.508 cm) and about 0.5 inch (1.27 cm). The inner wall portion 2610 may also vary in cross-sectional shape. In one example, one or more of the inner wall portions may have a rectangular cross-sectional shape. In another example, one or more of the inner wall portions may have an elliptical cross-sectional shape. In yet another example, one or more of the inner wall portions may have a trapezoidal cross-sectional shape. Alternatively, the cross-sectional configuration and/or the width of each inner wall portion may vary between the center portion 2600 and the outer wall portion 2630. The apparatus, methods, and articles of manufacture described herein are not limited in this regard.

The outer wall portion 2630 may have a second thickness ($T_2$) that may be less than the first thickness ($T_2<T_1$) but greater than the face portion thickness. However, the thickness of the outer wall portion 2630 may vary. The second thickness may be generally defined as the thickness of the face portion 2575 at or near the outer wall portion 2630. The outer wall portion 2630 may at least partially surround the center portion 2600. In the example of FIG. 26, the outer wall portion 2630 resembles a loop that surrounds the center portion 2600. In one example, the first thickness may be between about 0.1 inches (0.25 cm) and about 0.2 (0.50 cm) inches ($0.1<T_1<0.2$), and the second thickness may be between 0.05 inches (0.13 cm) and 0.15 inches (0.38 cm). In another example, the first thickness may be between about 0.125 inches (0.32 cm) and about 0.175 inches (0.44 cm), and the second thickness may be between about 0.075 inches (0.19 cm) and about 0.125 inches (0.32 cm). The apparatus, methods, and articles of manufacture described herein are not limited in this regard.

Between the center portion 2600, the inner wall portions 2610 and the outer wall portion 2630, the inner side 2590 of the face portion 2575 may include back portion regions 2650, which are generally shown as back portion regions 2652, 2654, 2656, 2658, 2659, 2660, and 2662. Each of the back portion regions 2652, 2654, 2656, 2658, 2659 and 2660 may be bound by the center portion 2600, two adjacent inner wall portions 2610 and a corresponding portion of the outer wall portion 2630. The back portion region 2662 may surround the outer wall portion 2630. The back portion regions 2650 may have the same thickness or have different thicknesses. The back portion regions 2650 may have a third thickness ($T_3$), which may be less than the first thickness ($T_3<T_1$) and the second thickness ($T_3<T_2$). The third thickness may be generally defined as the thickness of the face portion 2575 at or near the back portion regions 2650. In one example, the thickness of any of the back portion regions 2650 may be the same as the face portion thickness. In one example, the back portion regions 2650 may have a third thickness of between about 0.03 inches (0.762 cm) and about 0.14 inch (0.36 cm). In another example, the back portion regions 2650 may have a third thickness of between about 0.05 inch (0.127 cm) and about 0.12 inches (0.30 cm). In another example, the back portion regions 2650 may have a similar thickness as the face portion thickness. The apparatus, methods, and articles of manufacture described herein are not limited in this regard.

Each of the inner wall portions 2610 may have a constant thickness or variable thickness. In one example, the thickness of each of the inner wall portions 2610 may transition from the first thickness ($T_1$) to the second thickness ($T_2$) in a direction from the center portion 2600 to the outer wall portion 2630 as the inner wall portion 2610 extends from the center portion 2600 to the outer wall portion 2630. Accordingly, the thickness of each inner wall portion 2610 may be similar to the first thickness ($T_1$) at the connection region between the inner wall portion 2610 and the center portion 2600, and the thickness of each inner wall portion 2610 may be similar to the second thickness ($T_2$) at the connection region between the inner wall portion 2610 and the outer wall portion 2630. The apparatus, methods, and articles of manufacture described herein are not limited in this regard.

According to the examples described herein and shown in FIG. 26, the face portion 2575 may include a first region that is also referred to as the center portion 2600 at or proximate to the impact area of the face portion 2575 and has a first thickness $T_1$ that is greater than the face portion thickness. The face portion 2575 may include a second region that is also referred to herein as the outer wall portion 2630, which at least partially surrounds the first region and has a second thickness $T_2$ that is less than the first thickness $T_1$. The face portion 2575 may include a plurality of third regions that are also referred to as the inner wall portions 2610 and have a constant or variable thickness of less than or equal to the first thickness $T_1$ and greater than or equal to the second thickness $T_2$. The face portion 2575 may include a plurality of fourth regions that are also referred to herein as the back portion regions 2650 and have a third thickness $T_3$ of less than the first thickness $T_1$ and the second thickness $T_2$, or alternatively, have the third thickness $T_3$ that is similar to the face portion thickness. The back portion region 2662 may be referred to herein as a fifth region that has the third thickness $T_3$ and surrounds the second region or the outer wall portion 2630. Thus, the face portion 2575 includes a plurality of regions having different thicknesses configured as described herein. The apparatus, methods, and articles of manufacture described herein are not limited in this regard.

Figure 27:
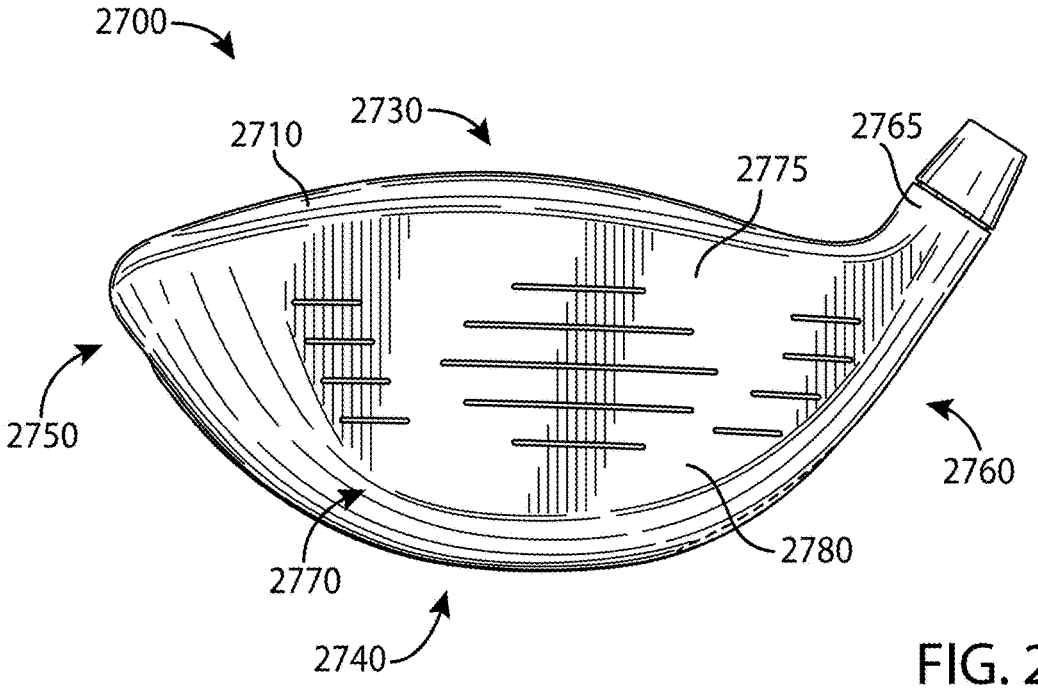
FIG. 27 depicts a front view of another example golf club head.
Figure 28:
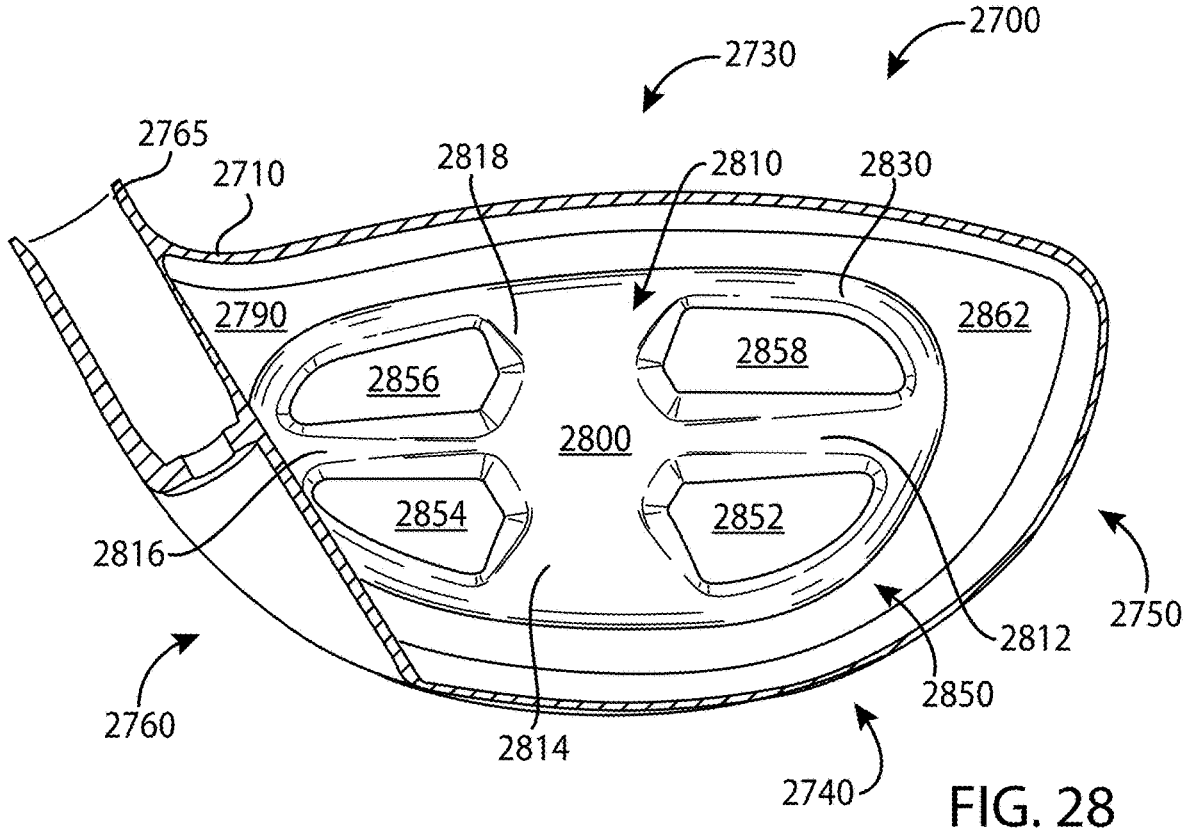
FIG. 28 depicts a cross-sectional view of an example face portion of the example golf club head of FIG. 27.
Figure 29:
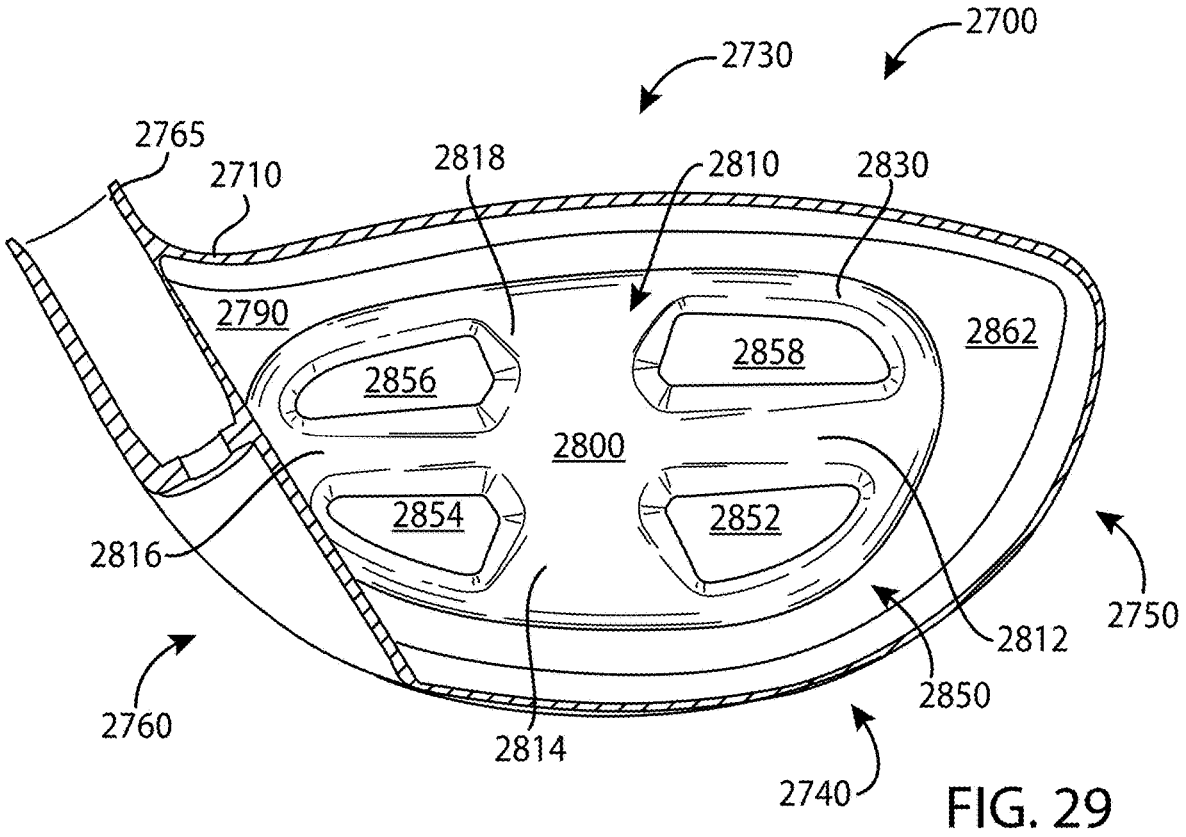
FIG. 29 depicts a cross-sectional view of another example face portion of the example golf club head of FIG. 27.

In the example of FIGS. 27-29, a golf club head 2700 may include a body portion 2710, which may include a top portion 2730, a bottom portion 2740, a toe portion 2750, a heel portion 2760, a front portion 2770, and a rear portion (not shown). The body portion 2710 may also include a hosel portion 2765 to receive a shaft (not shown). Alternatively, the body portion 2710 may include a bore instead of the hosel portion 2765. The bottom portion 2740 may include one or more weight port regions (not shown), with each weight port region having a plurality of weight ports (not shown) configured to receive a plurality of weight portions (not shown). The weight port regions, weight ports and/or the weight portions may be similar in many respects to the weight port regions, weigh ports and weight portions described herein (e.g., as described in the above examples). Alternatively, the bottom portion 2740 may not have any weight port regions with weight ports and/or weight portions. The apparatus, methods, and articles of manufacture described herein are not limited in this regard.

The body portion 2710 may be made partially or entirely of an aluminum-based material, a magnesium-type material, a steel-based material, a titanium-based material, any combination thereof, or any other suitable material. In another example the body portion 2710 may be made partially or entirely of a non-metal material such as a ceramic material, a composite material, any combination thereof, or any other suitable material.

The golf club head 2700 may have a club head volume greater than or equal to 300 cubic centimeters (cm3 or cc). In one example, the golf club head 2700 may be about 460 cc. Alternatively, the golf club head 2700 may have a club head volume less than or equal to 300 cc. In particular, the golf club head 2700 may have a club head volume between 100 cc and 200 cc. The club head volume of the golf club head 2700 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2700. Although FIG. 27 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

The front portion 2770 may include a face portion 2775 having an outer side 2780, which may be also the strike face of the face portion 2775, and an inner side 2790. Portions of the face portion 2775 may have constant or varying thicknesses between the top portion 2730 and the bottom portion 2740 and/or between the toe portion 2750 and the heel portion 2760 as described herein. The smallest thickness of the face portion 2775 may be referred to herein as the face portion thickness ($T_{FP}$). In one example, the face portion thickness may be between 0.03 inch (0.762 cm) and 0.12 inch (0.305 cm) ($0.03<T_{FP}<0.12$). In another example, the face portion thickness may be between 0.04 inch (0.102 cm) and 0.1 inch (0.254 cm) ($0.04<T_{FP}<0.1$). In yet another example, the face portion thickness may be between 0.05 inch (0.127 cm) and 0.09 inch (0.229 cm) ($0.05<T_{FP}<0.09$). The apparatus, methods, and articles of manufacture described herein are not limited in this regard.

As illustrated in FIG. 28, for example, the inner side 2790 may include a center portion 2800 having a first thickness ($T_1$), which may be generally defined as the thickness of the face portion 2775 at or near the impact area of the face portion 2775. The impact area of the face portion 2775 may be defined as a central strip down the middle of the face portion 2775 having a width of about 1.68 inches (4.27 cm). The center portion 2800 may be within the impact area of the face portion 2775. Accordingly, in one example, the center portion 2800 may have a radius of less than or equal to about 0.84 inch (2.144 cm). The radius of the center portion may refer to the largest distance from a geometric center of the center portion 2800 to the boundary of the center portion 2800 with the center portion having any symmetrical or asymmetrical shape. In another example, the center portion 2800 may have a radius of less than or equal to about 0.7 inch (1.778 cm). In yet another example, the center portion 2800 may have a radius of less than or equal to about 0.6 inch (1.524 cm). In yet another example, the center portion 2800 may have a radius of less than or equal to about 0.5 inch (1.27 cm). In yet another example, the center portion 2800 may have a radius of less than or equal to about 0.4 inch (1.27 cm). In yet another example, the center portion 2800 may have a radius that is generally similar to the radius of a golf ball (not shown). Alternatively, the center portion 2800 may be larger than the impact area. Further, portions of the center portion 2800 may extend outside the impact area while other portions of the center portion 2800 may be within the impact area. The apparatus, methods, and articles of manufacture described herein are not limited in this regard.

The first thickness may be greater than the face portion thickness ($T_1>T_{FP}$). The center portion 2800 may be located generally at the impact area of the face portion 2775 or on an area of the face portion 2775 that is used to strike a golf ball (not shown). The center portion 2800 may be offset relative to the geometric center of the face portion 2775 toward the top portion 2730, the bottom portion 2740, the toe portion 2750, or the heel portion 2760. The center portion 2800 may have any shape. For example, the center portion 2800 may be generally one or a combination of a square shape, a rectangular shape, a triangular shape, a circular shape, an elliptical shape, a pentagonal shape, a hexagonal shape, a polygonal shape, or a star shape. The apparatus, methods, and articles of manufacture described herein are not limited in this regard.

The inner side 2790 of the face portion 2775 may include a plurality of inner wall portions 2810, which are generally shown in FIG. 28 as inner wall portions 2812, 2814, 2816 and 2818. Accordingly, in the example of FIG. 28, the body portion 2710 includes four inner wall portions 2810 (i.e., first to fourth inner wall portions). A wall portion (e.g., inner wall portion or outer wall portion) as described herein may define a portion or a region of the inner side 2790 of the face portion 2775 that projects from the inner side 2790 of the face portion 2775 into the body portion 2710. In other words, a wall portion as described herein may define a portion or a region of the face portion 2775 that has a greater thickness than the face portion thickness. The inner side 2790 may include any number of inner wall portions 2810. The inner wall portions 2810 may extend from the center portion 2800 to an outer wall portion 2830 on the inner side 2790. The inner wall portions 2810 may be connected to the center portion 2800 and/or connected to the outer wall portion 2830. The inner wall portions 2810 may extend from the center portion 2800 to the outer wall portion 2830 in any configuration (i.e., in any orientation, angle, spacing between adjacent inner wall portions, etc.).

For example, the inner wall portion 2812 may extend from the center portion 2800 toward the toe portion 2750. The inner wall portion 2814 may extend from the center portion 2800 toward the bottom portion 2740. The inner wall portion 2816 may extend from the center portion 2800 toward the heel portion 2760. The inner wall portion 2818 may extend from the center portion 2800 toward the top portion 2730.

Further, the inner wall portions 2810 may vary in width. In one example shown in FIG. 29, the inner wall portions 2812 and 2816 are wider than the inner wall portions 2812 and 2816 of FIG. 28. Thus, the example of FIG. 29 is similar in many respects to the example of FIG. 29 except for the width of the inner wall portions 2812 and 2816. In another example, the width of any of the inner wall portions 2810 may be between about 0.1 inch (0.254 cm) and about 0.75 inch (1.905). In one example, the width of any or the inner wall portion 2810 may be between about 0.2 inch (0.508 cm) and about 0.5 inch (1.27 cm). The inner wall portions 2810 may also vary in cross-sectional shape. In one example, one or more of the inner wall portions may have a rectangular cross-sectional shape. In another example, one or more of the inner wall portions may have an elliptical cross-sectional shape. In yet another example, one or more of the inner wall portions may have a trapezoidal cross-sectional shape. Alternatively, the cross-sectional configuration and/or the width of each inner wall portion may vary between the center portion 2800 and the outer wall portion 2830. The apparatus, methods, and articles of manufacture described herein are not limited in this regard.

The outer wall portion 2830 may have a second thickness ($T_2$) that may be less than the first thickness ($T_2<T_1$) but greater than the face portion thickness. However, the thickness of the outer wall portion 2830 may vary. The second thickness may be generally defined as the thickness of the face portion 2775 at or near the outer wall portion 2830. The outer wall portion 2830 may at least partially surround the center portion 2800. In the example of FIG. 28, the outer wall portion 2830 resembles a loop that surrounds the center portion 2800. In one example, the first thickness may be between about 0.1 inches (0.25 cm) and about 0.2 (0.50 cm) inches, and the second thickness may be between 0.05 inches (0.13 cm) and 0.15 inches (0.38 cm). In another example, the first thickness may be between about 0.125 inches (0.32 cm) and about 0.175 inches (0.44 cm), and the second thickness may be between about 0.075 inches (0.19 cm) and about 0.125 inches (0.32 cm). The apparatus, methods, and articles of manufacture described herein are not limited in this regard.

Between the center portion 2800, the inner wall portions 2810 and the outer wall portion 2830, the inner side 2790 of the face portion 2775 may include back portion regions 2850, which are generally shown as back portion regions 2852, 2854, 2856, 2858 and 2862. Each of the back portion regions 2852, 2854, 2856 and 2858 may be bound by the center portion 2800, two adjacent inner wall portions 2810 and a corresponding portion of the outer wall portion 2830. The back portion region 2862 may surround the outer wall portion 2830. The back portion regions 2850 may have the same thickness or have different thicknesses. The back portion regions 2850 may have a third thickness ($T_3$), which may be less than the first thickness ($T_3<T_1$) and the second thickness ($T_3<T_2$). The third thickness may be generally defined as the thickness of the face portion 2775 at or near the back portion regions 2850. In one example, the thickness of any of the back portion regions 2850 may be the same as the face portion thickness. In one example, the back portion regions 2850 may have a third thickness of between about 0.03 inches (0.762 cm) and about 0.14 inch (0.36 cm). In another example, the back portion regions 2850 may have a third thickness of between about 0.05 inch (0.127 cm) and about 0.12 inches (0.30 cm). In another example, the back portion regions 2850 may have a similar thickness as the face portion thickness. The apparatus, methods, and articles of manufacture described herein are not limited in this regard.

Each of the inner wall portions 2810 may have a constant thickness or variable thickness. In one example, the thickness of each of the inner wall portions 2810 may transition from the first thickness ($T_1$) to the second thickness ($T_2$) in a direction from the center portion 2800 to the outer wall portion 2830 as the inner wall portion 2810 extends from the center portion 2800 to the outer wall portion 2830. Accordingly, the thickness of each inner wall portion 2810 may be similar to the first thickness ($T_1$) at the connection region between the inner wall portion 2810 and the center portion 2800, and the thickness of each inner wall portion 2810 may be similar to the second thickness ($T_2$) at the connection region between the inner wall portion 2810 and the outer wall portion 2830. The apparatus, methods, and articles of manufacture described herein are not limited in this regard.

According to the examples described herein and shown in FIG. 28, the face portion 2775 may include a first region that is also referred to as the center portion 2800 at or proximate to the impact area of the face portion 2775 and has a first thickness $T_1$ that is greater than the face portion thickness. The face portion 2775 may include a second region that is also referred to herein as the outer wall portion 2830, which at least partially surrounds the first region and has a second thickness $T_2$ that is less than the first thickness $T_1$. The face portion 2775 may include a plurality of third regions that are also referred to as the inner wall portions 2810 and have a constant or variable thickness of less than or equal to the first thickness $T_1$ and greater than or equal to the second thickness $T_2$. The face portion 2775 may include a plurality of fourth regions that are also referred to herein as the back portion regions 2850 and have a third thickness $T_3$ of less than the first thickness $T_1$ and the second thickness $T_2$, or alternatively, have the third thickness $T_3$ that is similar to the face portion thickness. The back portion region 2862 may be referred to herein as a fifth region that has the third thickness $T_3$ and surrounds the second region or the outer wall portion 2830. Thus, the face portion 2775 includes a plurality of regions having different thicknesses configured as described herein. The apparatus, methods, and articles of manufacture described herein are not limited in this regard.

Figure 30:
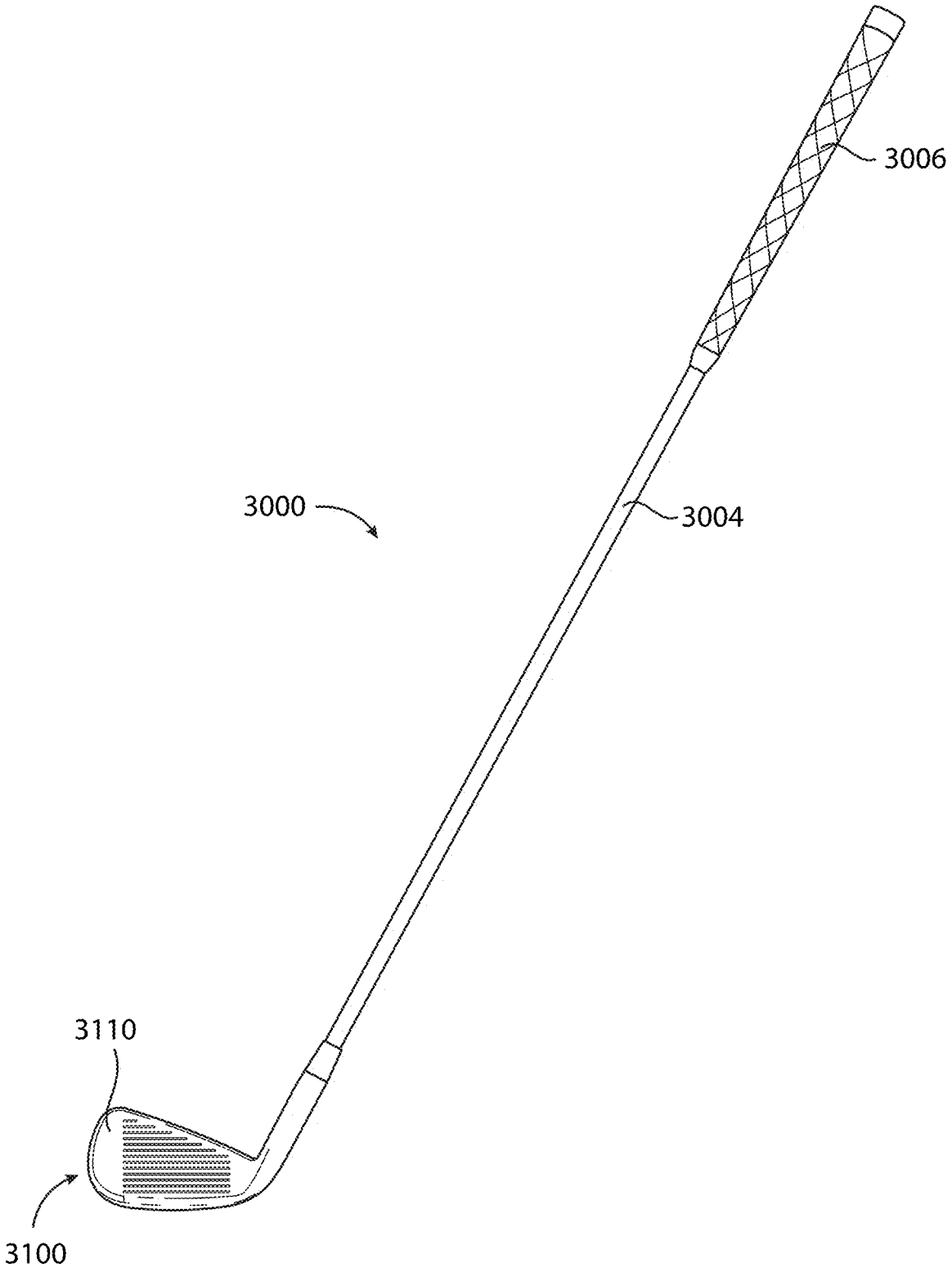
FIG. 30 depicts an example iron-type golf club according to an embodiment of the apparatus, methods, and articles of manufacture described herein.
Figure 31:
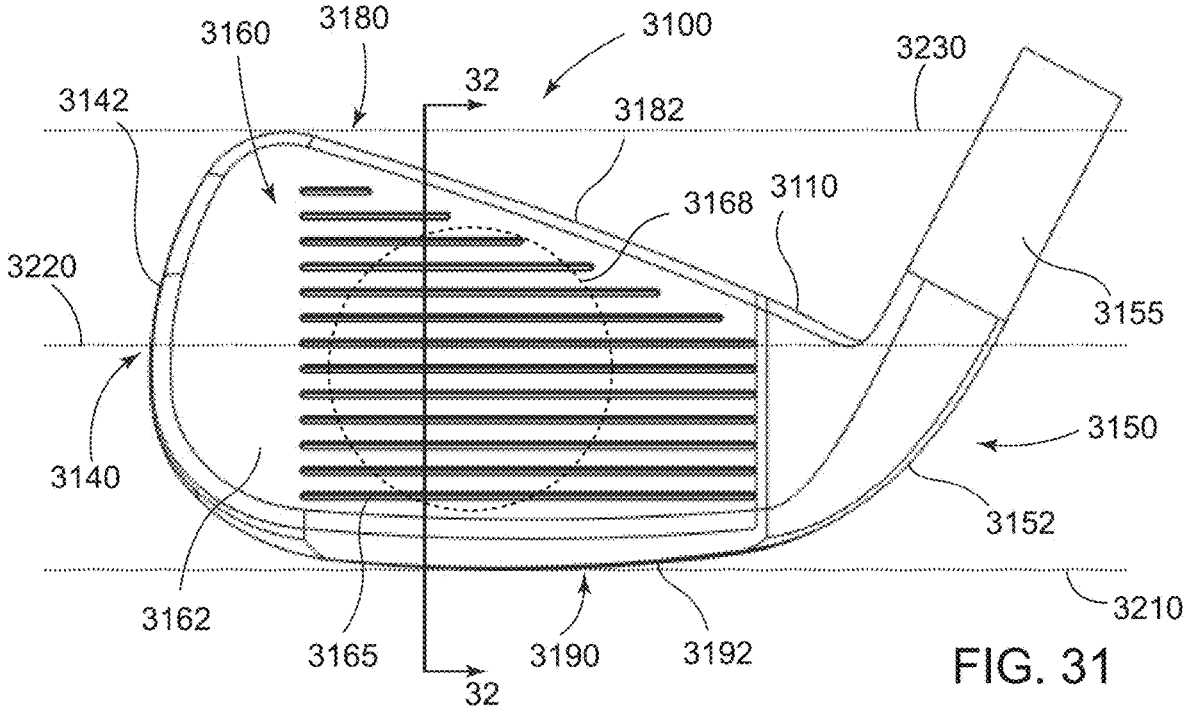
FIG. 31 depicts a front perspective view of an iron-type golf club according to an embodiment of the apparatus, methods, and articles of manufacture described herein.
Figure 32:
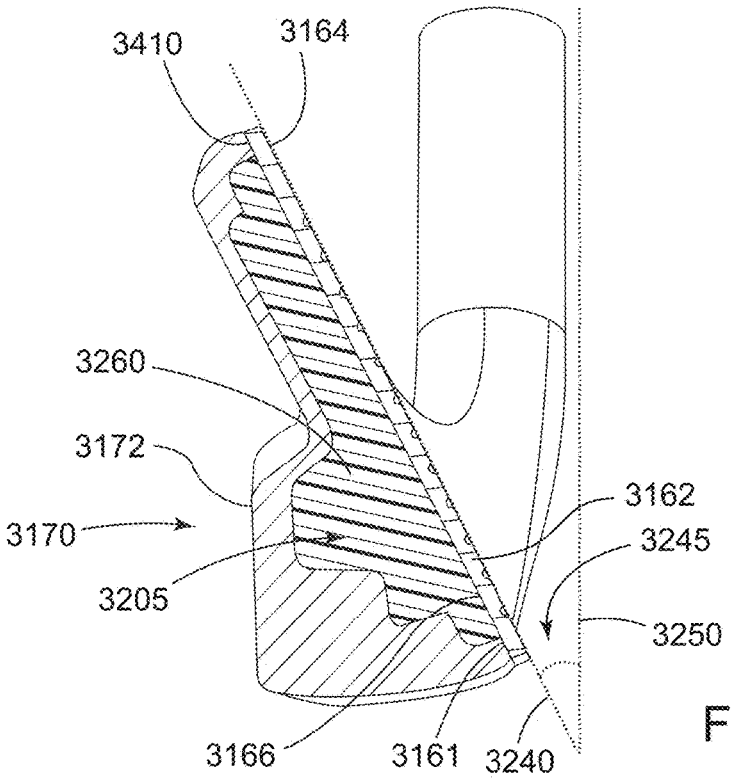
FIG. 32 depicts a cross-sectional view of the golf club head of FIG. 31 taken at line 32-32 of FIG. 31.

In the example of FIGS. 30-32, a golf club 3000 may include a golf club head 3100, a shaft 3004, and a grip 3006. The golf club head 3100 may be attached to one end of the shaft 3004 and the grip 3006 may be attached to the opposite end of the shaft 3004. An individual can hold the grip 3006 and swing the golf club head 3100 with the shaft 3004 to strike a golf ball (not illustrated). The golf club head 3100 may be an iron-type golf club head (e.g., a 1-iron, a 2-iron, a 3-iron, a 4-iron, a 5-iron, a 6-iron, a 7-iron, an 8-iron, a 9-iron, etc.) or a wedge-type golf club head (e.g., a pitching wedge, a lob wedge, a sand wedge, an n-degree wedge such as 44 degrees (°), 48°, 52°, 56°, 60°, etc.). The golf club head 3100 may be one golf club head of a set of golf club heads such as a set of irons, all of which may be similar in many respects to the golf club head 3100 as described herein. Although FIGS. 30-32 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard.

The golf club head 3100 may include a body portion 3110 having a toe portion 3140 with a toe portion edge 3142, a heel portion 3150 with a heel portion edge 3152 that may include a hosel portion 3155 configured to receive the shaft 3004, a front portion 3160, a back portion 3170 with a back wall portion 3172, a top portion 3180 with a top portion edge 3182, and a sole portion 3190 with a sole portion edge 3192. The toe portion edge 3142, the heel portion edge 3152, the top portion edge 3182, and the sole portion edge 3192 may define a periphery or perimeter of the body portion 3110. The toe portion 3140, the heel portion 3150, the front portion 3160, the back portion 3170, the top portion 3180, and/or the sole portion 3190 may partially overlap. For example, a portion of the toe portion 3140 may overlap portion(s) of the front portion 3160, the back portion 3170, the top portion 3180, and/or the sole portion 3190. In a similar manner, a portion of the heel portion 3150 may overlap portion(s) of the front portion 3160, the back portion 3170, the top portion 3180, and/or the sole portion 3190. In another example, a portion of the back portion 3170 may overlap portion(s) of the toe portion 3140, the heel portion 3150, the top portion 3180, and/or the sole portion 3190. The golf club head 3100 may be similar in many respects to any of the golf club heads described herein.

Figure 33:
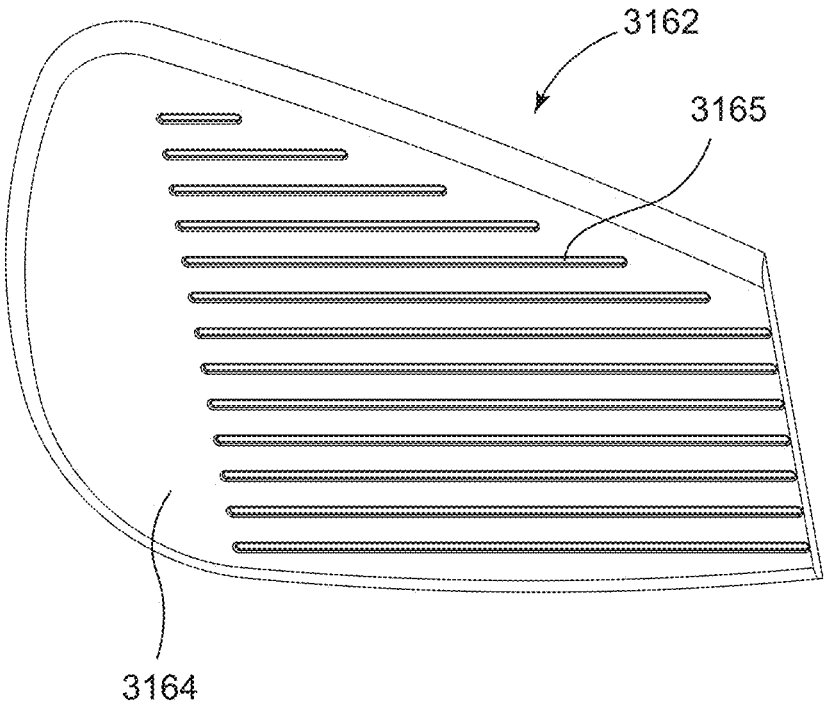
FIGS. 33-40 depict example face portions according to embodiments of the apparatus, methods, and articles of manufacture described herein.

The golf club head 3100 may include a face portion 3162 (i.e., the strike face), which may be integrally formed with the body portion 3110 (e.g., a single unitary piece). In one example, as illustrated in FIGS. 30-43, the face portion 3162 may be a separate part that is coupled (e.g., adhesively, mechanically, by welding, and/or by soldering with or without intermediate parts or layers) to the front portion 3160. The face portion 3162 may include a front surface 3164 and a back surface 3166. The front surface 3164 may include a front grooves 3165 that may extend horizontally between the toe portion 3140 and the heel portion 3150. The face portion 3162 may include any number of front grooves 3165. In one example, as illustrated in FIGS. 31 and 33, the face portion 3162 may include thirteen front grooves 3165. The face portion 3162 may include a ball strike region 3168. The ball strike region 3168 may define a region of the face portion 3162 that typically strikes a golf ball or has a high probability of striking a golf ball for a typical golfer. In one example, the center of the ball strike region 3168 may be a geometric center of the face portion 3162. In another example, the geometric center of the face portion 3162 may be offset from a geometric center of the ball strike region 3168. In one example, the geometric center and one or more regions near and/or surrounding the geometric center within the ball strike region 3168 may provide a generally optimum location (i.e., optimum ball distance, ball speed, ball spin characteristics, etc.) on the face portion 3162 for striking a golf ball. In yet another example, any location at or near the geometric center and within the ball strike region 3168 may provide a generally optimum location on the face portion 3162 for striking a golf ball. However, a ball may be struck with any portion of the face portion 3162 within the ball strike region 3168 or outside the ball strike region 3168 for any of the golf club heads described herein resulting in certain ball flight characteristics different from an on-center hit that may be preferred by an individual. The apparatus, methods, and articles of manufacture described herein are not limited in this regard.

The golf club head 3100 may be associated with a ground plane 3210, a horizontal midplane 3220, and a top plane 3230. In particular, the ground plane 3210 may be a plane that is parallel or substantially parallel to the ground and is tangent to the lowest portion of the sole portion edge 3192 when the golf club head 3100 is at an address position (e.g., the golf club head 3100 aligned to strike a golf ball). A top plane 3230 may be a plane that is tangent to the upper most portion of top portion edge 3182 when the golf club head 3100 is at the address position. The ground plane 3210 and the top plane 3230, respectively, may be parallel or substantially parallel to each other. The horizontal midplane 3220 may be vertically halfway between the ground plane 3210 and top plane 3230, respectively. Further, the golf club head 3100 may be associated with a loft plane 3240 defining a loft angle 3245 (*a*) of the golf club head 3100. The loft plane 3240 may be a plane that is tangent to the face portion 3162. The loft angle 3245 3245 may be defined by an angle between the loft plane 3240 and a vertical plane 3250 normal to the ground plane 3210.

The body portion 3110 may be hollow to include an interior cavity 3205. The interior cavity 3205 may extend between the front portion 3160, the back portion 3170, the top portion 3180, and the sole portion 3190. The interior cavity 3205 of the body portion 3110 may be fully or partially enclosed with the face portion 3162. Accordingly, in one example, an opening to the interior cavity 3205 at the front portion 3160 may be closed by the face portion 3162. As illustrated in FIG. 32, the front portion 3160 may include a perimeter edge portion 3161 that may couple directly or indirectly via additional layers or parts to the back surface 3166 of the face portion 3162. As a result, portions of the back surface 3166 of the face portion 3162 that are not coupled to the perimeter edge portion 3161 may be exposed to the interior cavity 3205. In another example, the interior cavity 3205 may be fully or partially enclosed from other parts or regions of the body portion 3110 that may have one or more openings connected to the interior cavity 3205. The interior cavity 3205 may be partially or fully filled with one or more filler materials 3260 that may be similar in many respects to any of the filler materials described herein. In one example, the back surface 3166 of the face portion 3162 may be engaged with the filler material 3260. Accordingly, the entire back surface 3166 of the face portion 3162 including any grooves, depressions, or any spaces between any projections may be filled with the filler material 3260. The apparatus, methods, and articles of manufacture described herein are not limited in this regard.

As illustrated in FIGS. 34-40, for example, the back surface 3166 of the face portion 3162 may include a center portion 3400 having a first thickness 3402 ($T_1$), a perimeter portion 3410 having a second thickness 3412 ($T_2$), a plurality of raised spokes 3420 extending radially from the center portion 3400 to the perimeter portion 3410 with each raised spoke having a third thickness 3422 ($T_3$), and a plurality of recessed spokes 3430 extending from the center portion 3400 to the perimeter portion 3410 with each recessed spoke 3430 having a fourth thickness 3432 ($T_4$). The center portion 3400 may generally correspond to the ball strike region 3168 or a portion of the ball strike region 3168 of the front surface 3164. In other words, the center portion 3400 may define all or a portion of a region of the face portion 3162 that may impact a golf ball or have a high probability of experiencing golf ball impact for a typical golfer. The center portion 3400 may have any geometric, non-geometric, symmetrical, or asymmetrical shape. In one example, as illustrated in 34-40, the center portion 3400 may be elliptical. Accordingly, the center portion 3400 may be defined by an ellipse having a boundary 3404 (i.e., periphery or perimeter), a major axis 3406, and a minor axis 3408. In one example, as illustrated in FIGS. 34-40, the major axis 3406 may extend in a direction between the toe portion 3140 and the heel portion 3150 and the minor axis 3408 is perpendicular to the major axis 3406. In another example, the major axis 3406 may extend in a direction between the top portion 3180 and the sole portion 3190 and the minor axis 3408 is perpendicular to the major axis 3406, which would render the center portion 3400 as a vertically oriented ellipse (i.e., vertically oblong). In yet other examples, the major axis 3406 may extend in a direction that may be at 30 degrees, at 45 degrees, or at any angle between and including 0 and 90 degrees from horizontal and the minor axis 3408 is perpendicular to the major axis 3406. The elliptical shape and size of the center portion 3400 may be determined by the length of the major axis 3406 and the length of the minor axis 3408 and defined by the following equation:

$$\frac{x^2}{b^2} + \frac{y^2}{a^2} = 1$$

Where:

(x, y) of (0, 0) is the intersection of the major axis 3406 and the minor axis 3408 the length of the major axis 3406 is 2a the length of the minor axis 3408 is 2b In another example, the center portion 3400 may be circular (i.e., a=b in the above equation). In another example, the center portion 3400 may be oblong shaped or lozenge shaped. In another example, the center portion 3400 may be a rounded rectangular shape. In yet another example, the center portion 3400 may have a compounded geometric shape (e.g., two overlapping circles resembling a figure eight shape). The apparatus, methods, and articles of manufacture described herein are not limited in this regard.

The thickness of the face portion 3162 may vary from the first thickness 3402 to the second thickness 3412. Accordingly, the second thickness 3412 may be greater than the first thickness 3402 ($T_2>T_1$). In one example, the first thickness 3402 may be greater than equal to 0.01 inch (0.254 mm) and the second thickness 3412 may be less than or equal to 0.20 inch (5.08 mm). In another example, the first thickness 3402 may be greater than or equal to 0.01 inch (0.254 mm) and the second thickness 3412 may be less than or equal to 0.09 inch (2.286 mm). In another example, the first thickness 3402 may be greater than or equal to 0.02 inch (0.508 mm) and the second thickness 3412 may be less than or equal to 0.11 inch (2.794 mm). In another example, the first thickness 3402 may be greater than or equal to 0.03 inch (0.762 mm) and the second thickness 3412 may be less than or equal to 0.125 inch (3.175 mm). In another example, the first thickness 3402 may be greater than or equal to 0.04 inch (1.016 mm) and the second thickness 3412 may be less than or equal to 0.15 inch (3.810 mm). In another example, the first thickness 3402 may be greater than or equal to 0.05 inch (1.270 mm) and the second thickness 3412 may be less than or equal to 0.175 inch (4.445 mm). In yet another example, the first thickness 3402 may be greater than or equal to 0.06 inch (1.524 mm) and the second thickness 3412 may be less than or equal to 0.2 inch (5.080 mm). The apparatus, methods, and articles of manufacture described herein are not limited in this regard.

Figure 34:
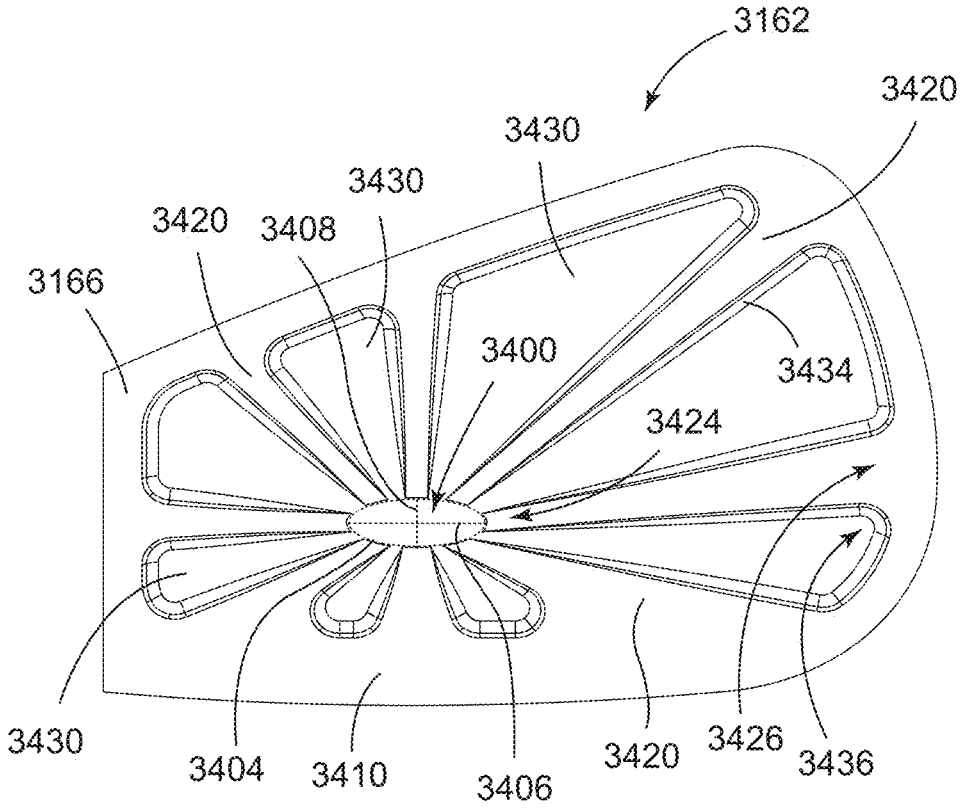
Figure 35:
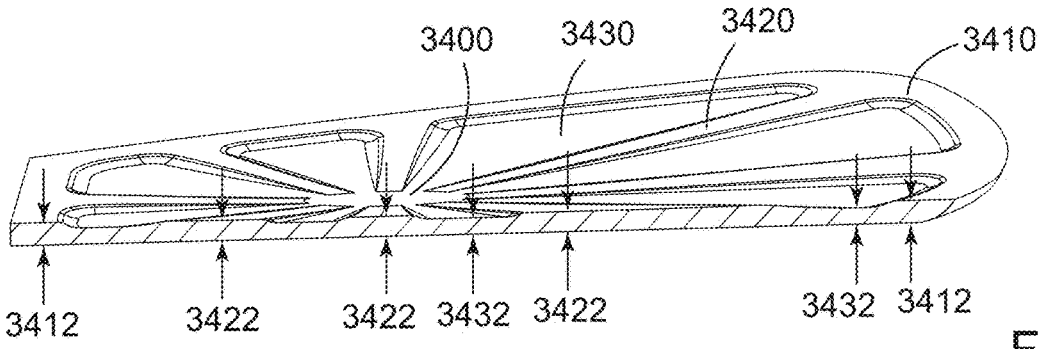
Figure 36:
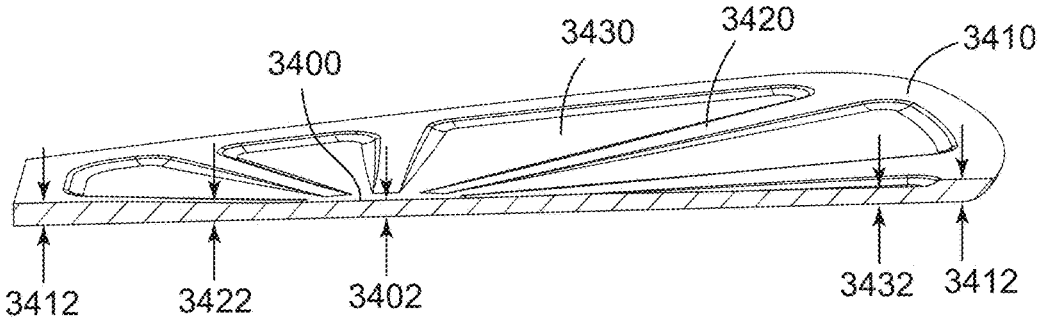
Figure 37:
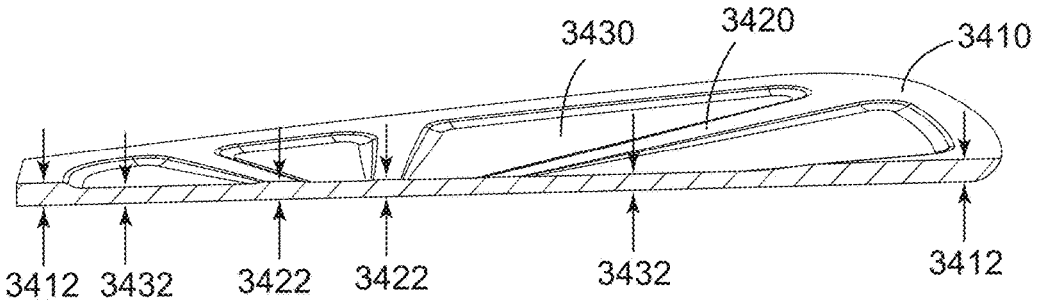
Figure 38:
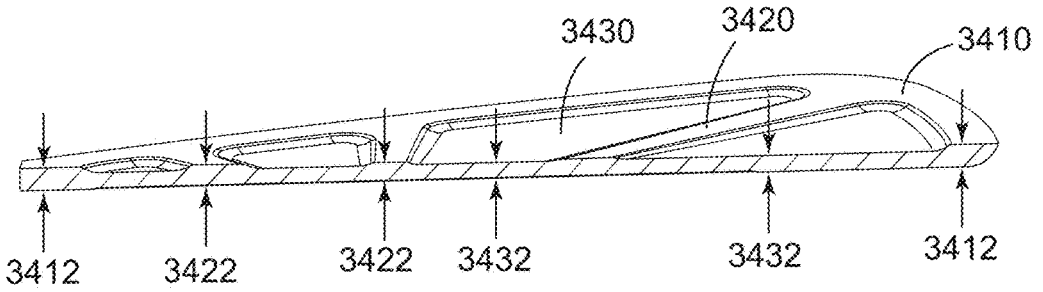
Figure 39:
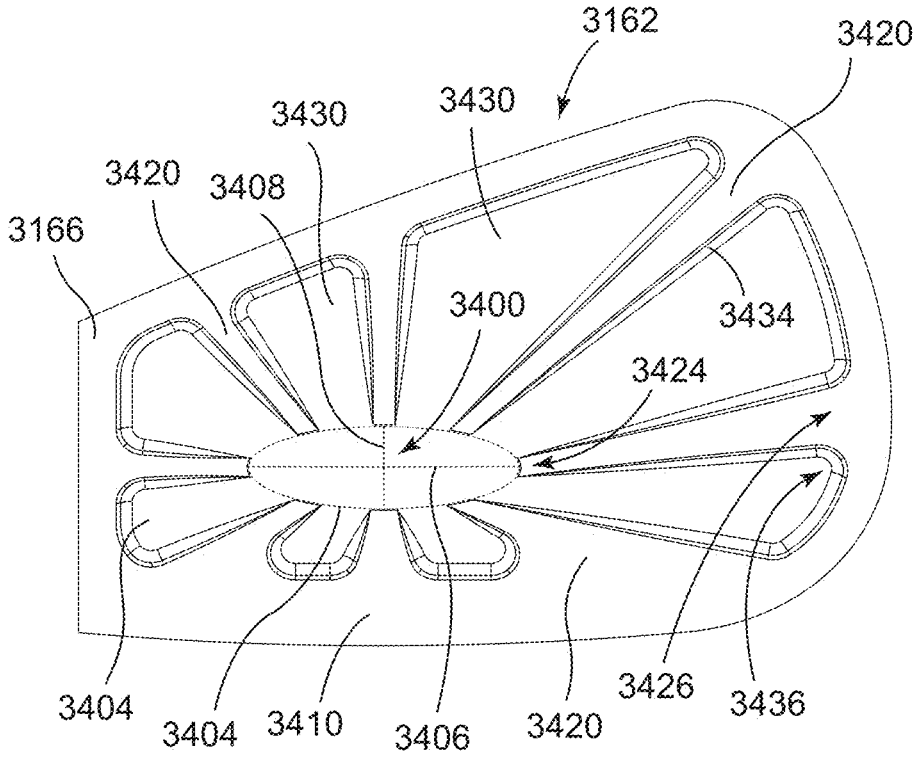
Figure 40:
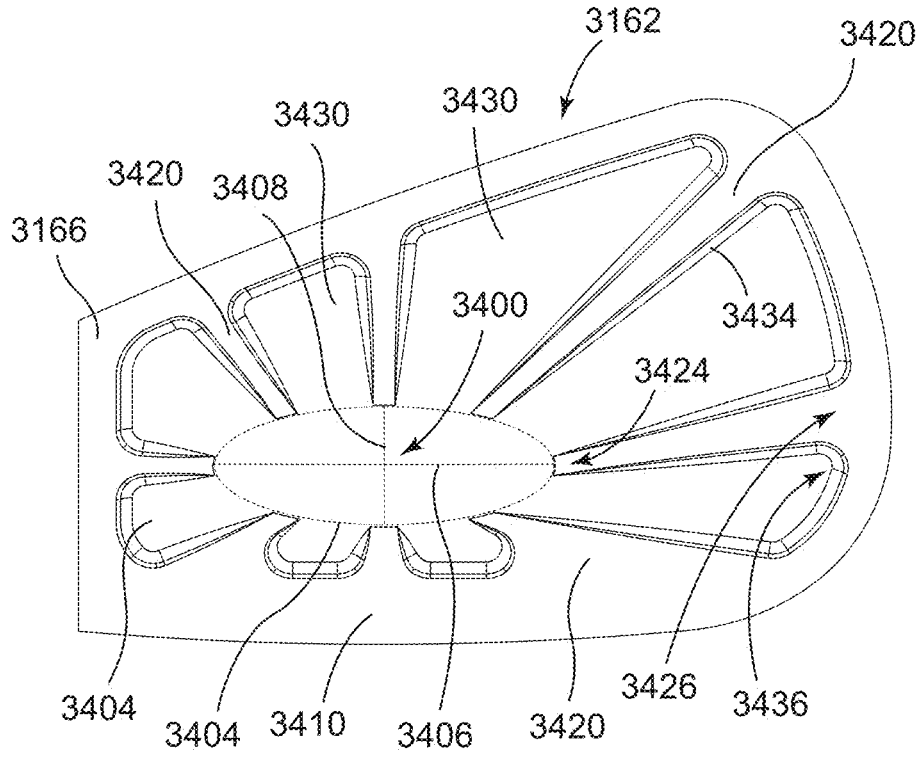

The size of the center portion 3400 may vary depending on a variety of physical properties and/or performance parameters of the golf club head 3100. In one example, the size of the center portion 3400 may depend on the loft angle 3245 of the golf club head 3100. For iron-type golf club heads, a lower loft angle 3245 golf club may be used to achieve a relatively high ball velocity and a relatively long ball distance, whereas higher loft angle 3245 golf club may be used to achieve a relatively high ball trajectory and a relatively low ball distance. As a result, a lower loft angle 3245 golf club may experience greater ball impact forces and the resulting higher face deflections than a higher loft angle 3245 golf club. Accordingly, to account for higher impact forces experienced by lower loft angle golf clubs, in one example, an increase in the size of the center portion 3400 may be proportional to an increase in the loft angle 3245 of the golf club head 3100, and a decrease in the size of the center portion 3400 may be proportional to a decrease in the loft angle 3245 of the golf club head 3100. In one example, as illustrated in FIGS. 34, 39 and 40, the center portion 3400 of the face portion 3162 of FIG. 34 is smaller than the center portion 3400 of the face portion of FIG. 39, and the center portion 3400 of the face portion 3162 of FIG. 39 is smaller than the center portion 3400 of the face portion of FIG. 40. Accordingly, the loft angle 3245 of the face portion 3162 of FIG. 34 may be smaller than the loft angle 3245 of the face portion of FIG. 39, and the loft angle 3245 of the face portion 3162 of FIG. 39 may be smaller than the loft angle 3245 of the face portion of FIG. 40. In other words, because the center portion 3400 of the example of FIGS. 33-40 may represent the thinnest portion of the face portion 3162, lower loft angle golf club heads that experience higher impact forces may have relatively smaller center portions than higher loft angle golf club heads that experience relatively lower impact forces. In another example, the size, shape, and/or location of the center portion 3400 may not change and/or may not depend on the loft angle 3245. In one example, for a set of iron-type golf clubs, an area of the center portion may proportionally change from the lowest loft angle golf club head in the set to the highest loft angle golf club head in the set. In other words, the size of the center portion may be mathematically related to the loft angle. The apparatus, methods, and articles of manufacture described herein are not limited in this regard.

As described herein, the center portion 3400 may be elliptical such that the shape and size of the center portion 3400 may be determined by the length of the major axis 3406 and the length of the minor axis 3408. In one example, the major axis 3406 or the minor axis 3408 may be greater than or equal to 0.05 inch (1.27 mm) and less than or equal to 2.5 inch (63.5 mm). In another example, the major axis 3406 or the minor axis 3408 may be greater than or equal to 0.25 inch (6.35 mm) and less than or equal to 2 inch (50.8 mm). In another example, the major axis 3406 or the minor axis 3408 may be greater than or equal to 0.5 inch (12.7 mm) and less than or equal to 1.5 inch (38.1 mm). In yet another example, the major axis 3406 or the minor axis 3408 may be greater than or equal to 1 inch (25.4 mm) and less than or equal to 1.25 inch (31.75 mm). The apparatus, methods, and articles of manufacture described herein are not limited in this regard.

In one example, as illustrated in FIGS. 34-40, each raised spoke 3420 may extend from the center portion 3400 to the perimeter portion 3410. Each raised spoke 3420 may include a spoke inner edge 3424 at the boundary 3404 of the center portion 3400 and a spoke outer edge 3426 at the perimeter portion 3410. The third thickness 3422 at the spoke inner edge 3424 or the thickness of the raised spoke 3420 at the boundary 3404 may be the same as the first thickness 3402 or the thickness of the center portion 3400 ($T_3=T_1$ at the spoke inner edge 3424). The third thickness 3422 at the spoke outer edge 3426 or the thickness of the raised spoke 3420 at the perimeter portion 3410 may be the same as the second thickness 3412 or the thickness of the perimeter portion 3410 ($T_3=T_2$ at the spoke outer edge 3426). In one example, as illustrated in FIGS. 34-40, the third thickness 3422 may gradually increase from the first thickness 3402 to the second thickness 3412. Accordingly, each raised spoke 3420 may increase in thickness from the center portion 3400 to the perimeter portion 3410. In another example, the third thickness 3422 may increase in a discrete or stepwise manner. In another example, the variation in the third thickness 3422 may be based on a linear function, nonlinear function (e.g., parabolic), or any mathematical expression based on the length, width, location on the face portion 3162, loft angle of the golf club head, or other physical parameters of each raised spoke 3420. In yet another example, the third thickness 3422 may be constant or substantially constant considering manufacturing tolerances. Accordingly, the third thickness 3422 may have the same value from the spoke inner edge 3424 to the spoke outer edge 3426. The spoke inner edge 3424 may transition to the center portion 3400 by a beveled or chamfered transition edge (not shown). The apparatus, methods, and articles of manufacture described herein are not limited in this regard.

The face portion 3162 may include any number of raised spokes 3420. As described herein, the thickness of each raised spoke 3420, or the third thickness 3422 may increase from the center portion 3400 to the perimeter portion 3410. As a result, an increase in the number of raised spokes 3420 may provide an increase in the overall thickness and the structural strength of the face portion 3162. Accordingly, the number of raised spokes 3420 may be related to the loft angle 3245 of the face portion 3162. In one example, the number of raised spokes 3420 may increase with a decrease in the loft angle 3245, whereas the number of raised spokes may decrease with an increase in the loft angle 3245. In another example, the widths of the raised spokes 3420 may increase with a decrease in the loft angle 3245, whereas the widths of the raised spokes may decrease with an increase in the loft angle 3245. In another example, the face portion 3162 may include greater than or equal to two raised spokes 3420 and less than or equal to 24 raised spokes 3420. In one example, for a set of iron-type golf clubs, the number of spokes may proportionally change from the lowest loft angle golf club head in the set to the highest loft angle golf club head in the set. In another example, one or more portions of the face portion 3162 may include a greater number of raised spokes 3420 and/or raised spokes 3420 that may have greater thicknesses than other portions of the face portion 3162. For example, the raised spokes 3420 that extend from the center portion 3400 toward the sole portion edge 3192 may have a greater thickness on average than the raised spokes 3420 that extend from the center portion 3400 toward the top portion edge 3182. The face portion 3162 may include any number of raised spokes 3420 with certain width and/or thickness profiles at any portion of the face portion 3162 to provide enhanced structural reinforcement and flexibility for one or more portions of the face portion 3162 and/or to impart certain ball flight characteristics (e.g., spin) for the one or more portions of the face portion 3162. In other words, the configuration of the raised spokes 3420 at any portion or the entire face portion 3162, such as the number, arrangement, thicknesses, widths, and spacing, and other physical features of the raised spokes 3420 may be determined to impart certain structural and performance characteristics for the golf club head 3100. The configuration of each or a plurality of raised spokes 3420 may also depend on the loft angle of the golf club head 3100 as described herein. The apparatus, methods, and articles of manufacture described herein are not limited in this regard.

As described herein the face portion 3162 may include any number of raised spokes 3420 with any shape or properties to provide certain structural strength and/or performance characteristics for the face portion 3162 at any loft angle 3245. In addition to adjusting the number of raised spokes 3420, the width of each raised spoke 3420 may also be determined to provide certain structural strength for the face portion 3162. In other words, depending on the number of raised spokes 3420, wider raised spokes 3420 may provide greater structural strength for the face portion 3162 than narrower raised spokes 3420. The width of each raised spoke 3420 may gradually increase from the width at the spoke inner edge 3424 to the width at the spoke outer edge 3426. In one example, the width of the spoke inner edge 3424 may be greater than or equal to 0.01 inch (0.254 mm) and less than or equal to 0.5 inch (12.7 mm). In another example, the width of the spoke inner edge 3424 may be greater than or equal to 0.05 inch (1.27 mm) and less than or equal to 0.25 inch (6.35 mm). In yet another example, the width of the spoke inner edge 3424 may be greater than or equal to 0.1 inch (2.54 mm) and less than or equal to 0.2 inch (5.08 mm). In one example, the width of the spoke outer edge 3426 may be greater than or equal to 0.025 inch (0.635 mm) and less than or equal to 1.25 inch (31.75 mm). In another example, the width of the spoke outer edge 3426 may be greater than or equal to 0.075 inch (1.905 mm) and less than or equal to 0.75 inch (19.05 mm). In another example, the width of the spoke outer edge 3426 may be greater than or equal to 0.125 inch (3.175 mm) and less than or equal to 0.5 inch (12.7 mm). In yet another example, the width of the spoke outer edge 3426 may be greater than or equal to 0.175 inch (4.445 mm) and less than or equal to 0.25 inch (6.35 mm). Each raised spoke 3420 may have any type of width profile to provide certain structural strength for the face portion 3162. In one example, the widths of one or more raised spokes 3420 may decrease from the center portion 3400 to the perimeter portion 3410. In another example, the widths of one or more raised spokes 3420 may be constant or substantially constant (i.e., minor variations due to manufacturing tolerances) from the center portion 3400 to the perimeter portion 3410. The apparatus, methods, and articles of manufacture described herein are not limited in this regard.

Each recessed spoke 3430 may be defined by a space between adjacent raised spokes 3420. Additionally, each recessed spoke 3430 may extend from the center portion 3400 to the perimeter portion 3410. In other words, each recessed spoke 3430 represents a recessed portion of the face portion 3162 between the two spokes adjacent to the recessed spoke 3430. In one example, as illustrated in FIGS. 34-40, each recessed spoke 3430 may have the same thickness or the fourth thickness 3432 as the thickness of the center portion 3400 or the first thickness 3402 ($T_4=T_1$). Accordingly, each recessed spoke 3430 may be defined as an extension of the center portion 3400 between adjacent raised spokes 3420. Each recessed spoke 3430 may include spoke walls 3434 with chamfered or rounded corners 3436 that provide a smooth transition between each recessed spoke 3430 and each adjacent raised spoke 3420, and between each recessed spoke 3430 and the perimeter portion 3410 to reduce stress concentration regions on the face portion 3162. In another example, each recessed spoke 3430 may have a different thickness or thickness profile than the center portion 3400. The apparatus, methods, and articles of manufacture described herein are not limited in this regard.

In one example, all or certain regions of the perimeter portion 3410 may define the thickest portion of the face portion 3162 or the second thickness 3412. As illustrated in the example of FIG. 32, the perimeter portion 3410 may partially or fully provide a coupling or engagement surface for attachment of the face portion 3162 to the perimeter edge portion 3161 of the front portion 3160 of the body portion 3110 to enclose the interior cavity 3205 at the front portion 3160. Accordingly, the perimeter portion 3410 may provide a peripheral structural support for the face portion 3162. In other words, impact forces on the center portion 3400 or surrounding the center portion 3400 may be transferred to the perimeter portion 3410 via the raised spokes 3420 and the recessed spokes 3430 and dissipated through the body portion 3110 via the perimeter edge portion 3161 of the front portion 3160. The apparatus, methods, and articles of manufacture described herein are not limited in this regard.

Figure 41:
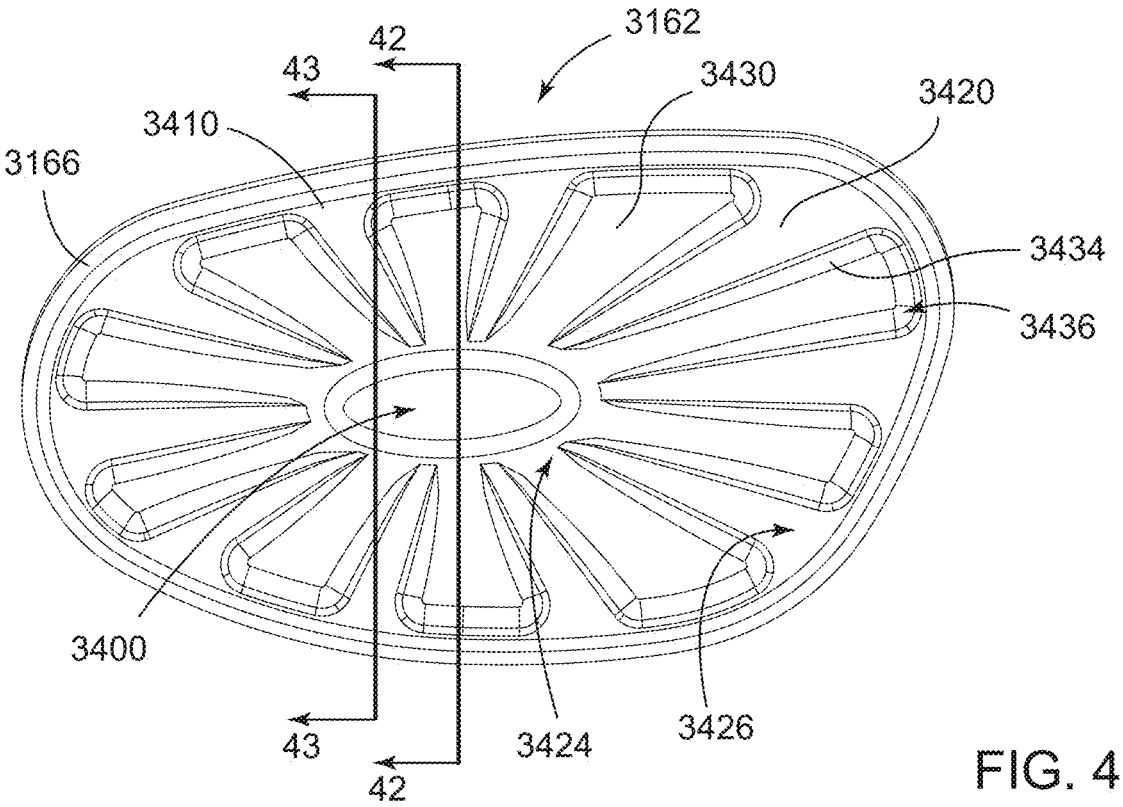
FIGS. 41, 42, and 43 depict a face portion, a cross-sectional view taken at line 42-42 of FIG. 41, a cross-sectional view taken at line 43-43 of FIG. 41 respectively, according to an embodiment of the apparatus, methods, and articles of manufacture described herein.
Figure 42:
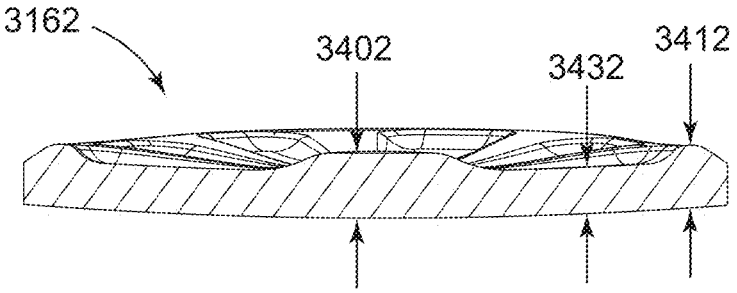
Figure 43:
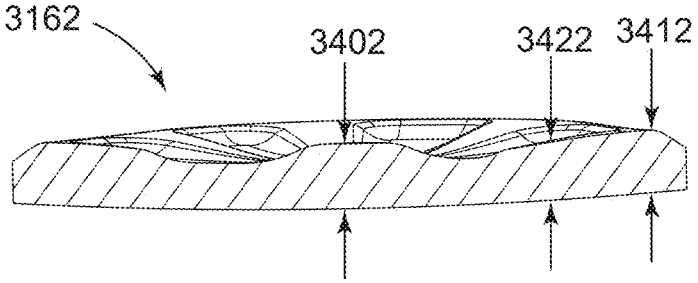

In another example, a driver-type golf club head, such as the driver-type golf club head shown in FIGS. 1-9, a fairway wood type golf club head shown in FIG. 21, and/or hybrid type golf club head shown in FIG. 22 (collectively referred to herein as a driver-type golf club head), may be used to achieve a high ball velocity and a long ball distance. As a result, a driver-type golf club head may experience relatively higher impact forces and the resulting higher face deflections than an iron-type golf club head. Accordingly, in one example of a face portion of a driver-type golf club as illustrated in FIGS. 41-43, the first thickness 3402 may be greater than the fourth thickness 3432 and greater than the third thickness 3422 at the spoke inner edge 3424. In another example, the first thickness 3402 may be equal to or proximate in value to the second thickness 3412. In another example, the first thickness 3402 may be greater than the second thickness 3412. In another example, the first thickness 3402 may be equal to the third thickness 3422 at a location between the spoke inner edge 3424 and the spoke outer edge 3426. In yet another example, the first thickness 3402 may vary with the loft angle for any type of golf club head (e.g., be proportional to changes in loft angle as described herein), such as an iron-type golf club head, a hybrid-type golf club head, and/or a driver-type golf club head. The first thickness 3402 may be proportional to average impact forces experienced by certain types of golf club heads. Accordingly, in contrast to the face portion of FIGS. 34-40, golf club heads according to the example of FIGS. 41-43 that experience higher ball impact forces may have center portions 3400 with a relatively greater first thickness 3402 because the first thickness 3402 may represent a relatively thicker portion or in some instances the thickest portion of the face portion 3162. The size, shape, thickness, and/or other physical properties of the center portion 3400 may vary with certain properties of a golf club head such as the type of golf club head, the loft angle 3245, the materials of constructions of the golf club head and/or the face portion, center of gravity of the golf club head, moment of inertia of the golf club head about one or more golf club head axes, and/or other properties of the golf club head. As also illustrated in the examples described and illustrated herein, the number and/or the properties of the raised spokes 3420 may vary depending on the loft angle and/or average impact forces experienced by a certain types of golf club heads. Accordingly, golf club heads that experience higher ball impact forces may have a relatively greater number of raised spokes 3420 in comparison to golf club heads that experience relative lower ball impact forces. The face portions 3162 of FIGS. 33-43 may be used in any type of golf club head and may not be limited to a specific type of golf club head such as iron-type golf club heads or driver-type golf club heads. The apparatus, methods, and articles of manufacture described herein are not limited in this regard.

As described herein, the interior cavity 3205 may be partially or entirely filled with one or more filler materials (i.e., a cavity filling material), which may include one or more similar or different types of materials. The amount (i.e., volume and/or mass) filler material may be determined for each golf club head (i.e., having a certain loft angle) to (i) provide vibration dampening or sound dampening (e.g., consistent and/or pleasing sound and feel when the golf club head strikes a golf ball as perceived by an individual using the golf club head), (ii) provide structural support for the face portion, and/or (iii) optimize ball travel distance, ball speed, ball launch angle, ball spin rate, ball peak height, ball landing angle and/or ball dispersion. The interior cavity 3205 may be filled with a filler material such that the back surface 3166 of the face portion is covered with the filler material and the recessed spokes 3430 are filled with the filler material. Accordingly, the filler material may provide structural support for the relatively thinner portions of the face portion 3162 such as the center portion 3400 and/or the recessed spokes 3430. A filler material as described herein may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, a filler material may be one or more thermoset polymers having bonding properties (e.g., one or more adhesive or epoxy materials). A material may also absorb shock, isolate vibration, and/or dampen noise when a golf club head as described herein strikes a golf ball. Further, a filler material may be an epoxy material that may be flexible or slightly flexible when cured. In another example, a filler material may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minnesota. In another example, a filler material may include 3M™ Scotch-Weld™ DP100 Plus Clear adhesive. In another example, a filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Michigan. In yet another example, a filler material may be LOCTITE® materials manufactured by Henkel Corporation, Rocky Hill, Connecticut. In another example, a filler material may be a polymer material such as an ethylene copolymer material that may absorb shock, isolate vibration, and/or dampen noise when a golf club head strikes a golf ball via the face portion. In another example, a filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Delaware. The DuPont™ HPF family of ethylene copolymers are injection moldable and may be used with conventional injection molding equipment and molds, provide low compression, and provide high resilience, i.e., relatively high coefficient of restitution (COR). In another example, any one or more of the filler materials described herein may be formed from one or more metals or metal alloys, such as aluminum, copper, zinc, and/or titanium. The apparatus, methods, and articles of manufacture described herein are not limited in this regard.

As described herein, the size, shape, and/or thickness of the center portion 3400 may vary with certain properties of a golf club head such as the type of golf club head and the loft angle 3245. In another example, the vertical location of the center portion 3400 may also vary with certain characteristics of the golf club head 3100. In another example, the horizontal location of the center portion 3400 may also vary with certain characteristics of the golf club head 3100. The characteristics of the golf club head 3100 that may affect the size, shape, and/or location of the center portion 3400 and the configuration and properties of the raised spokes 3420 and the recessed spokes 3430 may include the loft angle 3245, the area of the face portion 3162, materials of construction of the face portion 3162 (e.g, aluminum, titanium, steel), thickness profile and/or characteristics of the face portion 3162 at one or more locations on the face portion 3162, the number and characteristics of the front grooves 3165 on the front surface 3164 of the face portion, method of manufacturing the face portion 3162, the type of golf club head (e.g., iron-type golf club head, driver-type golf club head, hybrid-type golf club head), and/or any filler material in the interior cavity and the properties of the filler material. In one example, the configuration and properties of the face portion 3162 as described herein, such as a relatively thin ball strike region supported by raised spokes having certain thickness and width profiles, may provide greater face portion deflection, which in combination with one or more filler materials in the interior cavity, may provide a greater rebounding effect to increase the coefficient of restitution, and improve and/or optimize ball speed, launch angle, ball spin, and carry distance. In another example, the configuration and properties of the face portion 3162 as described herein, such as a relatively thicker ball strike region supported by raised spokes having certain thickness and width profiles, may provide greater face portion deflection while providing structural support for relatively high ball impact forces (i.e., such as for driver-type golf clubs), which in combination with one or more filler materials in the interior cavity, may provide a greater rebounding effect to increase the coefficient of restitution, and improve and/or optimize ball speed, launch angle, ball spin, and carry distance. The apparatus, methods, and articles of manufacture described herein are not limited in this regard.

While each of the above examples may describe a certain type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, a putter-type golf club head, etc.).

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cubic centimeters ($cm^3$ or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby," "neighboring," etc., and such terms may be used interchangeably as appearing in this disclosure.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having a front portion with a front opening to an interior cavity;

a face portion attached to the front portion to close the front opening, the face portion comprising:

a center portion having a first thickness;

a perimeter portion having a width extending from a perimeter edge of the face portion toward the center portion and having a second thickness greater than the first thickness;

a plurality of spoke portions extending radially from the center portion to the perimeter portion; and a plurality of recessed portions, each recessed portion located between two spoke portions, and each recessed portion extending from the center portion to the perimeter portion and being recessed relative to the perimeter portion, wherein the second thickness is a maximum thickness of the face portion, wherein a thickness of each spoke portion increases from the first thickness to the second thickness in a direction from the center portion to the perimeter portion, wherein each recessed portion has the first thickness from the center portion to the perimeter portion, wherein the perimeter portion and the plurality of spoke portions define a continuous back surface portion of the face portion, and wherein a maximum thickness of each spoke portion is the second thickness.

2. A golf club head as defined in claim 1, wherein the center portion and the plurality of recessed portions are filled with a polymer material.

3. A golf club head as defined in claim 1, wherein the interior cavity is at least partially filled with a polymer material.

4. A golf club head as defined in claim 1, wherein a size of the center portion is proportional to a loft angle of the face portion.

5. A golf club head as defined in claim 1, wherein at least two spoke portions of the plurality of spoke portions have different widths and different lengths.

6. A golf club head as defined in claim 1, wherein a width of each spoke portion increases in a direction from the center portion to the perimeter portion.

7. A golf club head as defined in claim 1, wherein a width of each recessed portion increases in a direction from the center portion to the perimeter portion.

8. A set of golf club heads comprising:

a first golf club head having a first loft angle, and at least a second golf club head having a second loft angle greater than the first loft angle, each golf club head comprising:

a body portion being hollow to define an interior cavity;

a face portion attached to the body portion, the face portion comprising:

a center portion having a first thickness;

a perimeter portion having a width extending from a perimeter edge of the face portion toward the center portion and having a second thickness greater than the first thickness;

a plurality of spoke portions extending radially from the center portion to the perimeter portion; and a plurality of recessed portions, each recessed portion located between two spoke portions and spaced apart from the perimeter edge by the perimeter portion, and each recessed portion extending from the center portion to the perimeter portion, wherein a thickness of each spoke portion increases from the first thickness to the second thickness in a direction from the center portion to the perimeter portion, and wherein each recessed portion has the first thickness from the center portion to the perimeter portion, and wherein an area of the center portion of the second golf club head is greater than an area of the center portion of the first golf club head, wherein the perimeter portion and the plurality of spoke portions define a continuous back surface portion of the face portion, wherein a maximum thickness of each spoke portion is the second thickness, and wherein a maximum thickness of the perimeter portion is the second thickness.

9. A set of golf club heads as defined in claim 8, wherein the center portion and the plurality of recessed portions of each of golf club heads are filled with a polymer material.

10. A set of golf club heads as defined in claim 8, wherein the interior cavity of each of the first golf club head and the second golf club head is at least partially filled with a polymer material.

11. A set of golf club heads as defined in claim 8, wherein an increase in the area of the center portion of the second golf club head compared to the area of the center portion of the first golf club head is proportional to an increase in the second loft angle compared to the first loft angle.

12. A set of golf club heads as defined in claim 8, wherein the center portion is elliptical, and wherein an end portion of each spoke defines a perimeter of the center portion.

13. A set of golf club heads as defined in claim 8, wherein a width of each spoke portion increases in a direction from the center portion to the perimeter portion.

14. A set of golf club heads as defined in claim 8, wherein a width of each recessed portion increases in a direction from the center portion to the perimeter portion.

15. A golf club comprising:

a shaft having a first end coupled to a grip and a second end; and a golf club head coupled to the second end of the shaft, the golf club head comprising:

a body portion having a front portion with a front opening to an interior cavity;

a face portion attached to the front portion to close the front opening, the face portion comprising:

a center portion having a first thickness;

a perimeter portion having a width extending from a perimeter edge of the face portion toward the center portion and having a second thickness greater than the first thickness;

a plurality of spoke portions extending radially from the center portion to the perimeter portion; and a plurality of recessed portions, each recessed portion located between two spoke portions, and each recessed portion extending from the center portion to the perimeter portion and being recessed relative to the perimeter portion, wherein the second thickness is a maximum thickness of the face portion, wherein a thickness of each spoke portion increases from the first thickness to the second thickness in a direction from the center portion to the perimeter portion, wherein each recessed portion has the first thickness from the center portion to the perimeter portion, wherein the perimeter portion and the plurality of spoke portions define a continuous back surface portion of the face portion, and wherein a maximum thickness of each spoke portion is the second thickness.

16. A golf club as defined in claim 15, wherein the center portion and the plurality of recessed portions are filled with a polymer material.

17. A golf club as defined in claim 15, wherein the interior cavity is at least partially filled with a polymer material.

18. A golf club as defined in claim 15, wherein the center portion is elliptical, and wherein an end portion of each spoke defines a perimeter of the center portion.

19. A golf club as defined in claim 15, wherein at least two spoke portions of the plurality of spoke portions have different widths and different lengths.

20. A golf club as defined in claim 15, wherein a width of each spoke portion and the width of each recessed portion increases in a direction from the center portion to the perimeter portion.

* * * * *